US011607009B2

(12) United States Patent
Hoffer et al.

(10) Patent No.: US 11,607,009 B2
(45) Date of Patent: Mar. 21, 2023

(54) ARTICLE OF FOOTWEAR

(71) Applicant: NIKE, Inc., Beaverton, OR (US)

(72) Inventors: Kevin W. Hoffer, Portland, OR (US); Cassidy R. Levy, West Linn, OR (US); Brian Linkfield, Beaverton, OR (US)

(73) Assignee: NIKE, Inc.

( * ) Notice: Subject to any disclaimer, the term of this patent is extended or adjusted under 35 U.S.C. 154(b) by 0 days.

(21) Appl. No.: 16/933,085

(22) Filed: Jul. 20, 2020

(65) Prior Publication Data

US 2021/0022443 A1 Jan. 28, 2021

Related U.S. Application Data

(60) Provisional application No. 62/923,655, filed on Oct. 21, 2019, provisional application No. 62/878,688, filed on Jul. 25, 2019.

(51) Int. Cl.
*A43B 13/18* (2006.01)
*A43B 7/144* (2022.01)
(Continued)

(52) U.S. Cl.
CPC ..... *A43B 13/186* (2013.01); *A43B 7/144* (2013.01); *A43B 7/1485* (2013.01);
(Continued)

(58) Field of Classification Search
CPC ... A43B 13/186; A43B 13/187; A43B 13/188; A43B 13/42; A43B 13/125;
(Continued)

(56) References Cited

U.S. PATENT DOCUMENTS 2,930,149 A 3/1960 Hack
3,087,262 A 4/1963 Russell
(Continued)

FOREIGN PATENT DOCUMENTS

CH 283034 A 5/1952
CN 2620493 Y 6/2004
(Continued)

OTHER PUBLICATIONS

European Patent Office (ISA), International Search Report and Written Opinion for PCT Application No. PCT/US2020/042784, dated Sep. 17, 2020.

(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

A sole structure for an article of footwear includes a cushioning element having a top surface, a bottom surface formed on an opposite side of the cushioning element from the top surface, a ramp surface spaced apart from the bottom surface in a heel region of the cushioning element, a heel pocket extending through the cushioning element from the top surface to the ramp surface, and a plurality of pillars extending from the ramp surface and surrounding the pocket. The sole structure additionally includes a plurality of cushioning particles disposed within the pocket, an outsole attached to the cushioning element and enclosing a first end of the pocket, and an upper barrier layer attached to the top surface of the cushioning element and covering a second end of the pocket.

20 Claims, 18 Drawing Sheets

(51) Int. Cl.
*A43B 13/12* (2006.01)
*A43B 13/14* (2006.01)
*A43B 13/42* (2006.01)
*A43B 7/1485* (2022.01)

(52) U.S. Cl.
CPC ..... *A43B 13/125* (2013.01); *A43B 13/146* (2013.01); *A43B 13/188* (2013.01); *A43B 13/42* (2013.01)

(58) Field of Classification Search
CPC ..... A43B 13/127; A43B 13/181; A43B 13/16; A43B 13/146; A43B 13/189; A43B 13/12; A43B 7/148; A43B 7/1485; A43B 7/144; A43B 7/146
USPC ..... 36/141
See application file for complete search history.

(56) References Cited

U.S. PATENT DOCUMENTS 3,469,576 A 9/1969 Smith
3,552,044 A 1/1971 Wiele
3,608,215 A 9/1971 Fukuoka
3,724,106 A 4/1973 Magidson
3,765,422 A 10/1973 Smith
3,906,570 A 9/1975 Revill
3,971,839 A 7/1976 Taylor
4,170,078 A 10/1979 Moss
4,307,200 A 12/1981 Lichter et al.
4,343,047 A 8/1982 Lazowski et al.
4,345,387 A 8/1982 Daswick
4,524,529 A 6/1985 Schaefer
4,547,978 A * 10/1985 Radford ..... A43B 7/081 36/29
4,658,515 A 4/1987 Oatman
4,686,781 A 8/1987 Bury
4,724,627 A 2/1988 Sisco
4,823,799 A 4/1989 Robbins
4,905,320 A 3/1990 Squyers, Jr.
4,970,807 A 11/1990 Anderie et al.
5,005,575 A 4/1991 Geri
5,150,490 A 9/1992 Busch et al.
5,231,776 A 8/1993 Wagner
5,363,570 A 11/1994 Allen et al.
5,378,223 A 1/1995 Grim et al.
5,383,290 A 1/1995 Grim
5,392,534 A 2/1995 Grim
5,517,770 A 5/1996 Martin et al.
5,617,650 A 4/1997 Grim
5,665,285 A 9/1997 Hattori et al.
5,718,064 A 2/1998 Pyle
5,753,357 A 5/1998 Filipitsch et al.
5,758,435 A 6/1998 Miyata
5,890,248 A 4/1999 Gee
5,920,915 A 7/1999 Bainbridge et al.
5,987,781 A 11/1999 Pavesi et al.
6,020,055 A 2/2000 Pearce
6,032,300 A 3/2000 Bainbridge et al.
6,061,928 A 5/2000 Nichols
6,098,209 A 8/2000 Bainbridge et al.
6,158,149 A 12/2000 Rudy
6,266,896 B1 7/2001 Liu
D460,852 S 7/2002 Daudier
6,425,195 B1 * 7/2002 Donzis ..... A41D 31/285 36/114
6,453,477 B1 9/2002 Bainbridge et al.
6,502,331 B2 1/2003 Hines
6,532,689 B1 3/2003 Jones, Jr.
6,635,203 B2 10/2003 Monaci
6,759,443 B2 7/2004 Brant et al.
6,782,640 B2 8/2004 Westin
6,848,200 B1 2/2005 Westin
6,878,753 B1 4/2005 Takemura et al.
7,036,245 B2 * 5/2006 Russell ..... A43B 7/1415 36/29
7,037,571 B2 5/2006 Fish et al.
7,069,672 B2 7/2006 Hahn
7,152,342 B2 12/2006 Sommer
7,484,317 B2 * 2/2009 Kita ..... A43B 13/10 36/27
7,484,318 B2 2/2009 Finkelstein
7,555,851 B2 7/2009 Hazenberg et al.
7,594,344 B2 9/2009 Mizrahi
7,805,859 B2 10/2010 Finkelstein
7,823,238 B2 11/2010 Din Mahamed
7,904,971 B2 3/2011 Doria et al.
7,966,750 B2 * 6/2011 Schindler ..... A43B 1/0027 36/29
8,091,254 B2 1/2012 Wang
8,178,022 B2 5/2012 Schindler et al.
8,272,149 B2 9/2012 Cooper et al.
8,671,591 B2 3/2014 Brown
8,713,817 B2 5/2014 Litchfield et al.
9,737,111 B2 8/2017 Lustik
10,098,411 B2 * 10/2018 Hoffer ..... A43B 13/141
10,098,412 B2 * 10/2018 Hoffer ..... A43B 13/186
10,674,788 B2 * 6/2020 Hoffer ..... A43B 13/20
2001/0000835 A1 5/2001 Hines
2001/0042321 A1 11/2001 Tawney et al.
2002/0157280 A1 * 10/2002 Russell ..... A43B 13/181 36/28
2003/0046831 A1 3/2003 Westin
2003/0217484 A1 11/2003 Christensen et al.
2005/0022424 A1 2/2005 Held
2005/0086728 A1 4/2005 Tobergte
2005/0150132 A1 7/2005 Iannacone
2006/0010717 A1 1/2006 Finkelstein
2006/0026863 A1 2/2006 Liu
2006/0130363 A1 6/2006 Hottinger
2006/0206977 A1 9/2006 Hammons et al.
2007/0051018 A1 3/2007 Issler
2007/0169379 A1 7/2007 Hazenberg et al.
2008/0066341 A1 3/2008 Hottinger
2008/0148599 A1 6/2008 Collins
2008/0230956 A1 9/2008 Allmendinger et al.
2009/0094855 A1 4/2009 Finkelstein
2009/0151093 A1 * 6/2009 Schindler ..... A61K 31/713 12/146 B
2009/0151196 A1 * 6/2009 Schindler ..... A43B 13/20 36/35 B
2009/0313853 A1 12/2009 Tadin
2010/0011618 A1 1/2010 Bitton
2010/0047550 A1 2/2010 Prissok et al.
2010/0154252 A1 6/2010 Avent et al.
2010/0222442 A1 9/2010 Prissok et al.
2010/0251565 A1 10/2010 Litchfield et al.
2011/0016747 A1 1/2011 Bitton
2011/0215497 A1 9/2011 McEvoy et al.
2012/0036698 A1 2/2012 Guertin
2012/0073163 A1 3/2012 Tse
2012/0204451 A1 8/2012 De Roode et al.
2012/0210602 A1 8/2012 Brown
2013/0008050 A1 1/2013 Marc
2013/0145653 A1 6/2013 Bradford
2013/0247422 A1 9/2013 Holt et al.
2014/0007456 A1 1/2014 Tadin
2014/0130269 A1 * 5/2014 Dabah ..... A43B 13/181 12/142 R
2014/0151918 A1 6/2014 Hartmann
2014/0223776 A1 8/2014 Wardlaw et al.
2014/0223777 A1 8/2014 Whiteman et al.
2014/0283413 A1 9/2014 Christensen et al.
2015/0196085 A1 7/2015 Westmoreland et al.
2015/0223564 A1 8/2015 Peyton et al.
2015/0257481 A1 9/2015 Campos, II et al.
2015/0264999 A1 9/2015 Marshall et al.
2016/0010717 A1 1/2016 Tosovsky
2016/0073732 A1 3/2016 Ernst et al.
2016/0157554 A1 6/2016 Adams
2016/0278481 A1 9/2016 Le et al.
2017/0055636 A1 3/2017 Campos, II et al.
2017/0265566 A1 * 9/2017 Case ..... A43B 13/186
2018/0077997 A1 * 3/2018 Hoffer ..... B32B 5/18
2018/0132564 A1 5/2018 Bruce et al.

(56) References Cited

U.S. PATENT DOCUMENTS

| | | | |
|---|---|---|---|
| 2018/0228248 | A1 | 8/2018 | Hazenberg et al. |
| 2018/0352900 | A1 | 12/2018 | Hartmann et al. |
| 2019/0343225 | A1 | 11/2019 | Reddy et al. |
| 2019/0380424 | A1 | 12/2019 | Tamm et al. |

FOREIGN PATENT DOCUMENTS

| | | | |
|---|---|---|---|
| CN | 1638663 | A | 7/2005 |
| CN | 2888936 | Y | 4/2007 |
| CN | 102481031 | A | 5/2012 |
| CN | 103747700 | A | 4/2014 |
| CN | 109952042 | A | 6/2019 |
| DE | 3406504 | A1 | 8/1985 |
| DE | 3627538 | A1 | 2/1988 |
| DE | 3723549 | A1 | 2/1988 |
| DE | 3839747 | A1 | 5/1990 |
| DE | 4202159 | A1 | 7/1993 |
| DE | 4401282 | A1 | 12/1994 |
| DE | 19938609 | A1 | 3/2001 |
| DE | 10138426 | C1 | 12/2002 |
| DE | 102009009589 | A1 | 9/2010 |
| EP | 130816 | A2 | 1/1985 |
| EP | 316289 | A2 | 5/1989 |
| EP | 0383685 | A1 | 8/1990 |
| EP | 529941 | A1 | 3/1993 |
| EP | 2649896 | B1 | 10/2016 |
| EP | 3386334 | A1 | 10/2018 |
| FR | 2642941 | A1 | 8/1990 |
| FR | 2824884 | A1 | 11/2002 |
| GB | 1301147 | A | 12/1972 |
| GB | 2066049 | A | 7/1981 |
| GB | 2462100 | A | 1/2010 |
| JP | H02252401 | A | 10/1990 |
| JP | 2008533327 | A | 8/2008 |
| JP | 2009056007 | A | 3/2009 |
| JP | 2014033742 | A | 2/2014 |
| JP | 2016182332 | A | 10/2016 |
| KR | 20120033710 | A | 4/2012 |
| TW | 385636 | U | 3/2000 |
| WO | WO-1997035496 | A1 | 10/1997 |
| WO | WO-2006049401 | A1 | 5/2006 |
| WO | WO-2008012809 | A2 | 1/2008 |
| WO | WO-2012177957 | A2 | 12/2012 |
| WO | WO-2013013784 | A1 | 1/2013 |
| WO | WO-2014126799 | A1 | 8/2014 |
| WO | WO-2018169535 | A1 | 9/2018 |
| WO | WO-2018175734 | A1 | 9/2018 |
| WO | WO-2020125963 | A1 | 6/2020 |

OTHER PUBLICATIONS

GE, Chengbiao et al., Steam-chest molding of expanded thermoplastic polyuerethane bead foams and their mechanical properties, Chemical Engineering Science 174 (2017) pp. 337-346.

Japan Patent Office, Notification of Reasons for Refusal for JP Application No. 2019-550843, dated Nov. 24, 2020.

European Patent Office, Communication pursuant to Article 94(3) EPC for EP Application No. 16777864.6, dated Dec. 16, 2020.

European Patent Office, Communication pursuant to Article 94(3) EPC for EP Application No. 16777863.8, dated Dec. 22, 2020.

KS65 Luxury Light Fescue—Field Green <http://www.kodiaksports.com/Artificial-Turf/Fake-Grass/Artificial-Grass-ST65_LFS_Field, Oct. 12, 2013, (Oct. 12, 2013), Retrieved from internet: URL:https://web.archive.org/web/*/http://www.kodiaksports.com/core/media/media.nl/id.28351/c.1268496/.f?h=1c04c87e9fd3f9d67f24 [retrieved on Dec. 15, 2016].

European Patent Office as the International Searching Authority, International Search Report and Written Opinion for PCT Application No. PCT/US2020/042735, dated Sep. 16, 2020.

European Patent Office as the International Searching Authority, International Search Report and Written Opinion for PCT Application No. PCT/US2020/042784, dated Sep. 17, 2020.

European Patent Office as the International Searching Authority, International Search Report and Written Opinion for PCT Application No. PCT/US2020/042807, dated Sep. 16, 2020.

Taiwan Office Action for Application 109111247 dated Apr. 30, 2021.

Japan Patent Office, Notice of Reasons for Rejection for JP Application No. 2020-017002 dated May 31, 2021.

Japan Patent Office, Notice of Reasons for Rejection for JP Application No. 2019-550853 dated May 25, 2021.

Japanese Office Action for Application No. 2020-017000 dated May 31, 2021.

China National Intellectual Property Administration, Second Office Action for application No. 201780088457.4 dated Jul. 19, 2021.

Taiwan Intellectual Property Office, Office Action dated Sep. 3, 2021 for application No. 109125077.

Taiwan Intellectual Property Office, Office Action dated Jun. 3, 2021 for application No. 109125078.

Taiwan Intellectual Property Office, Office Action dated Jun. 3, 2021 for application No. 109125079.

China National Intellectual Property Administration, Decision of Rejection Office Action dated Jun. 29, 2021 for application No. 201680062323.0.

China National Intellectual Property Office, Office Action for Application No. 201980047915.9 dated Jul. 30, 2021.

European Patent Office, Extended European Search Report for EP Application No. 22161547.9 dated Jun. 3, 2022.

United States Patent and Trademark Office, Non-Final Office Action for U.S. Appl. No. 16/493,952 dated Jul. 22, 2022.

USPTO, Non-Final Office Action for U.S. Appl. No. 16/493,994. dated Oct. 6, 2022.

* cited by examiner

ARTICLE OF FOOTWEAR

CROSS REFERENCE TO RELATED APPLICATIONS

This non-provisional U.S. patent application claims priority under 35 U.S.C. § 119(e) to U.S. Provisional Application No. 62/878,688, filed Jul. 25, 2019, and to U.S. Provisional Application No. 62/923,655, filed Oct. 21, 2019, the disclosures of which are hereby incorporated by reference in their entireties.

FIELD

The present disclosure relates to articles of footwear having a sole structure incorporating particulate matter.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
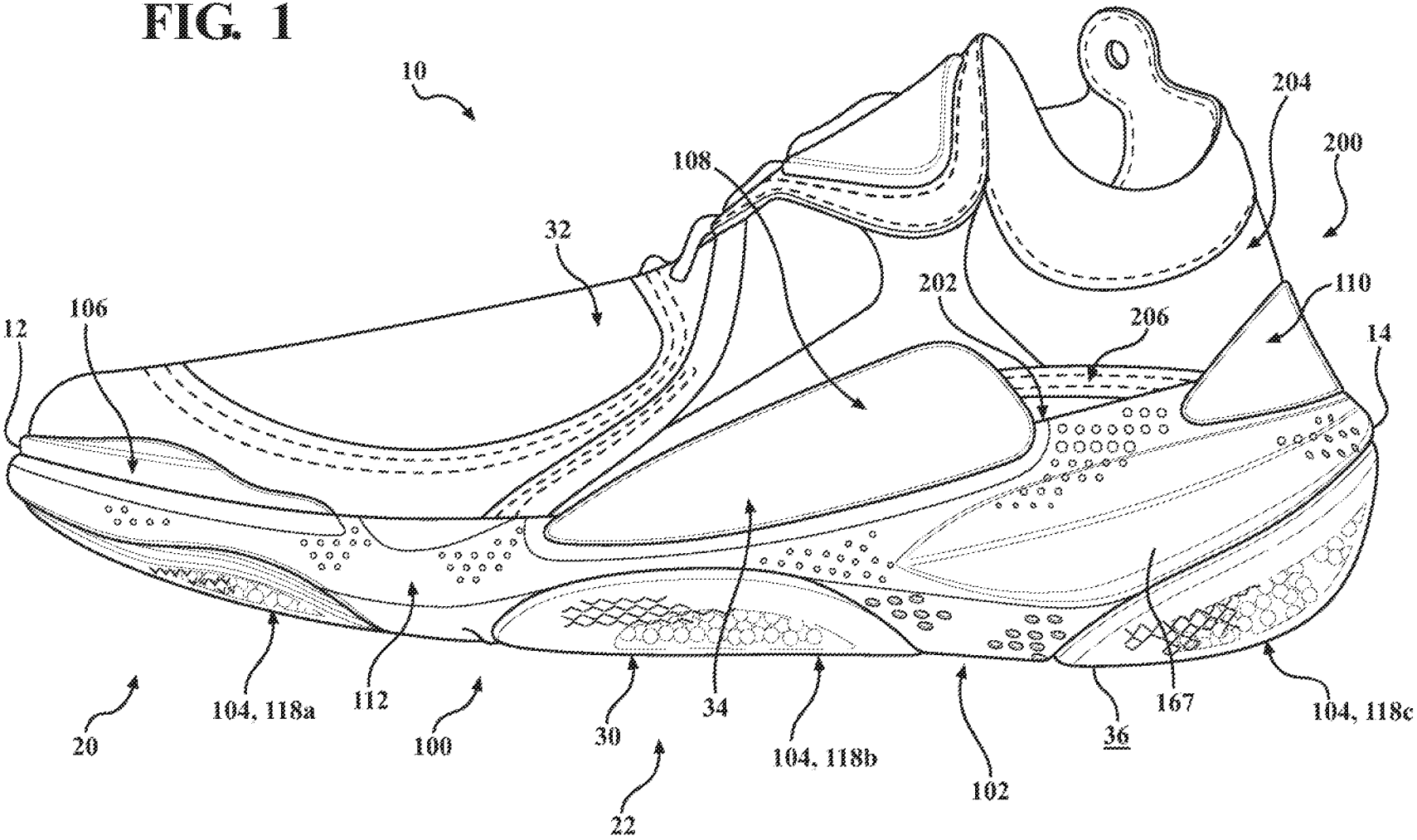
FIG. 1 is an lateral elevation view of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a cushioning element having a top surface, a bottom surface formed on an opposite side of the cushioning element from the top surface, a ramp surface spaced apart from the bottom surface in a heel region of the cushioning element, a heel pocket extending through the cushioning element from the top surface to the ramp surface, and a plurality of pillars extending from the ramp surface and surrounding the pocket. The sole structure additionally includes a plurality of cushioning particles disposed within the pocket, an outsole attached to the cushioning element and enclosing a first end of the pocket, and an upper barrier layer attached to the top surface of the cushioning element and covering a second end of the pocket.

The sole structure may additionally include one or more of the below optional features. For example, the plurality of pillars may be arranged along an arcuate path in the heel region. Additionally or alternatively, each of the pillars may extend from a first end attached to the ramp surface to a terminal end aligned with the bottom surface. Further, a cross-sectional area of at least one of the pillars may taper in a direction away from the ramp surface. Further yet, the pillars may be spaced inwardly from an outer periphery of the cushioning element and/or at least one of the pillars may be arcuate.

In one configuration, the heel pocket may include a bottom opening formed through the ramp surface. In this configuration, the plurality of pillars may be arranged around the bottom opening.

The cushioning element may further include a midfoot pocket and at least one forefoot pocket. A first rib may be disposed between the at least one forefoot pocket and the midfoot pocket, and a second rib may be disposed between the midfoot pocket and the heel pocket. Each of the first rib and the second rib may extend from a first end attached to a medial side of the cushioning element to a second end attached to a lateral side of the cushioning element. Further, each of the ribs may extend from an upper surface formed at the top surface of the cushioning element to a lower surface formed at the bottom surface of the cushioning element. Further yet, the upper surface may be recessed from the top surface of the cushioning element, and the lower surface may be coincident with the bottom surface of the cushioning element.

The upper barrier layer may be attached to the top surface of the cushioning element and the upper surface of each of the ribs to enclose each of the pockets. At least a portion of each of the ribs may be formed of a first material having a lower durometer than a second material forming a peripheral region of the cushioning element.

In one configuration, the outsole may be formed of a transparent material. Additionally or alternatively, the outsole may include a plurality of outsole elements.

The upper barrier layer may be formed of a permeable material and/or may be formed of a fabric material.

In another configuration, a sole structure for an article of footwear includes a cushioning element having a top surface, a bottom surface, and a ramp surface disposed in a heel region and offset towards the top surface from the bottom surface, the cushioning element including a channel having a bottom opening formed through the ramp surface, and one or more pillars extending from the ramp surface and surrounding the bottom opening. An outsole is attached to the cushioning element and covers the bottom opening and each of the pillars and a plurality of cushioning particles is disposed within the channel and surrounds each of the pillars.

The sole structure may additionally include one or more of the below optional features. For example, the one or more pillars may include a plurality of pillars arranged along an arcuate path in the heel region. Additionally or alternatively, each of the pillars may extend from a first end attached to the ramp surface to a distal end aligned with the bottom surface. A cross-sectional area of at least one of the pillars may taper in a direction away from the ramp surface. Further, the pillars may be spaced inwardly from an outer periphery of the cushioning element. Further yet, at least one of the pillars may be arcuate.

In one configuration, the channel may include at least one forefoot pocket, a midfoot pocket, and a heel pocket. The cushioning element may include a first rib disposed between the at least one forefoot pocket and the midfoot pocket, and a second rib disposed between the midfoot pocket and the heel pocket. Each of the first rib and the second rib may extend from a lateral end attached to a lateral side of the cushioning element to a medial end attached to a medial side of the cushioning element. Further, each of the ribs may extend from an upper surface formed at the top surface of the cushioning element to a lower surface formed at the bottom surface of the cushioning element. The upper surface may be recessed from the top surface of the cushioning element, and the lower surface may be coincident with the bottom surface of the cushioning element.

The upper barrier layer may be attached to the top surface of the cushioning element and the upper surface of each of the ribs to enclose the channel. At least a portion of each of the ribs may be formed of a first material having a lower durometer than a second material forming a peripheral region of the cushioning element.

In one configuration, the outsole may be formed of a transparent material. Additionally or alternatively, the outsole may include a plurality of outsole elements.

The upper barrier layer may be formed of a permeable material and/or may be formed of a fabric material.

Referring to FIG. 1, an article of footwear 10 includes a sole structure 100 and a bootie 200 attached to the sole structure 100. Generally, the sole structure 100 is configured to provide characteristics of cushioning and responsiveness to the article of footwear 10, while the bootie 200 is configured to receive a foot of a wearer to secure the foot of the wearer to the sole structure 100.

Figure 6:
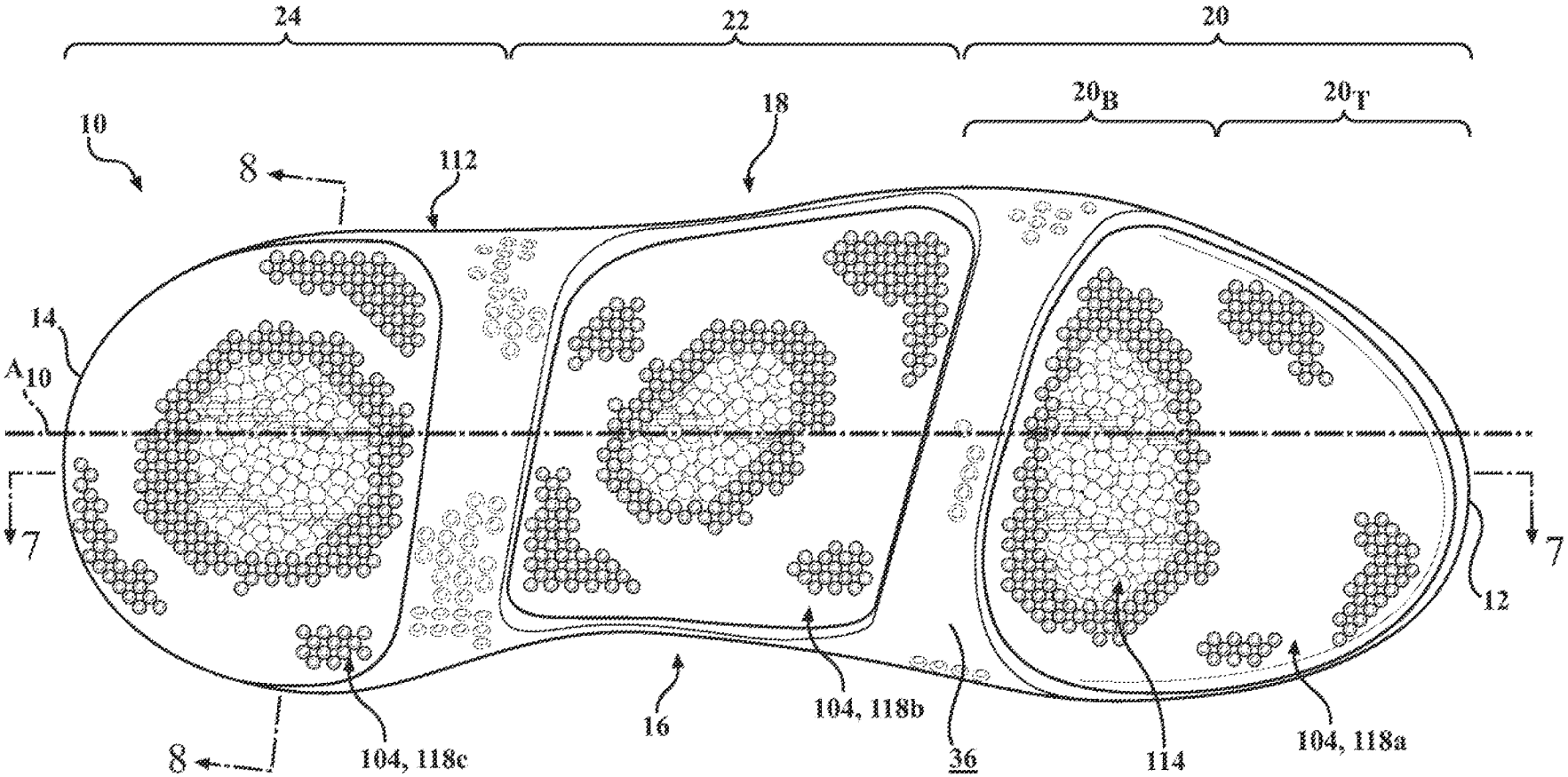
FIG. 6 is a bottom plan view of the article of footwear of FIG. 1.

The footwear 10 may further include an anterior end 12 associated with a forward-most point of the article of footwear 10, and a posterior end 14 corresponding to a rearward-most point of the footwear 10. As shown in FIG. 6, a longitudinal axis $A_{10}$ of the footwear 10 extends along a length of the footwear 10 from the anterior end 12 to the posterior end 14, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

Figure 7:
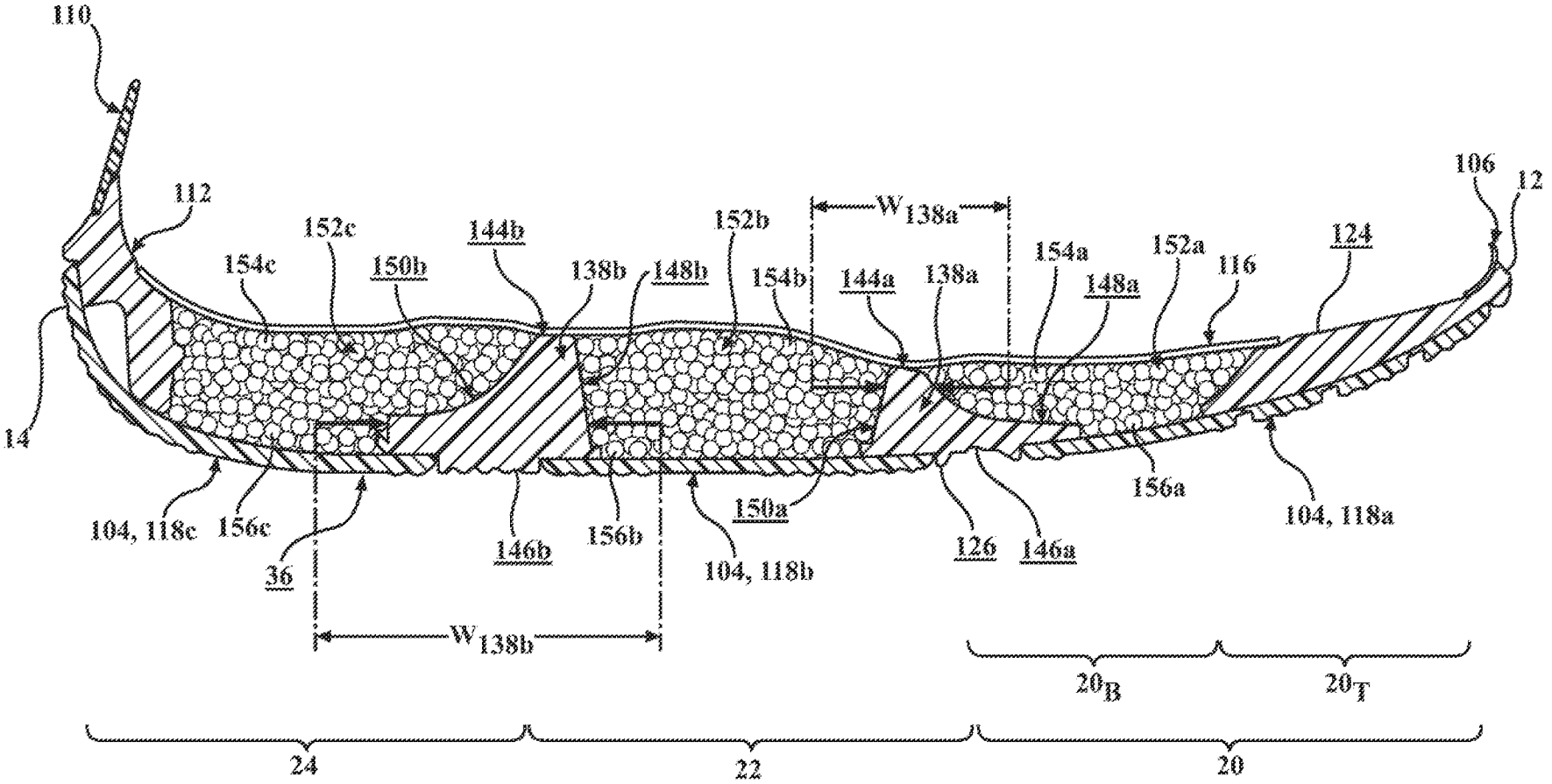
FIG. 7 is a cross-sectional view of a cushioning member of the article of footwear of FIG. 1 taken along Line 7-7 of FIG. 6.
Figure 8:
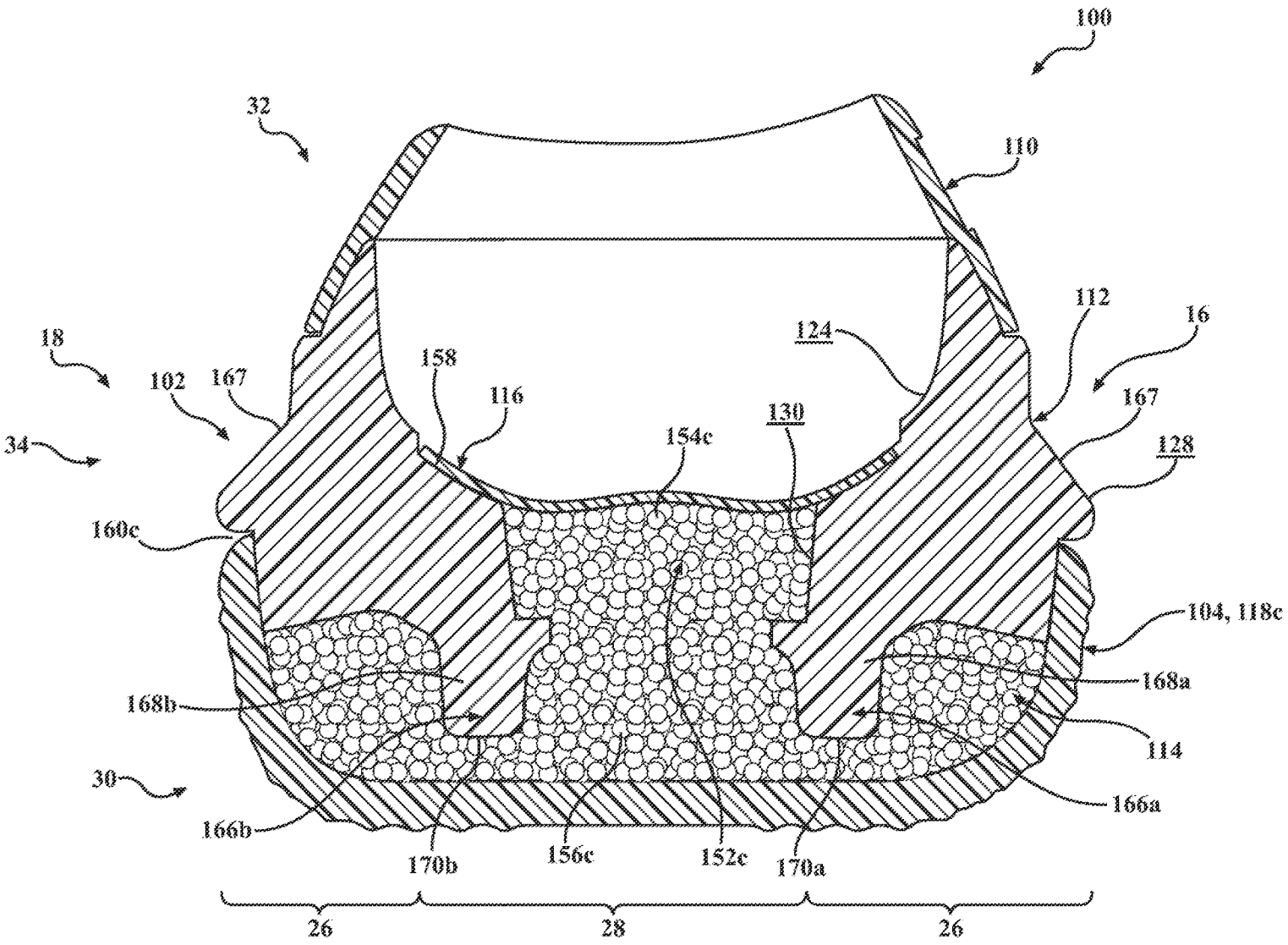
FIG. 8 is a cross-sectional view of a cushioning member of the article of footwear of FIG. 1 taken along Line 8-8 of FIG. 6.

The article of footwear 10 may be divided into one or more regions. The regions may include a forefoot region 20, a mid-foot region 22, and a heel region 24. As illustrated in FIGS. 6 and 7, the forefoot region 20 may be further subdivided into a toe portion $\mathbf{20}_T$ corresponding with phalanges and a ball portion $\mathbf{12}_B$ associated with metatarsal bones of a foot. The mid-foot region 22 may correspond with an arch area of the foot, and the heel region 24 may correspond with rear portions of the foot, including a calcaneus bone.

Figure 3:
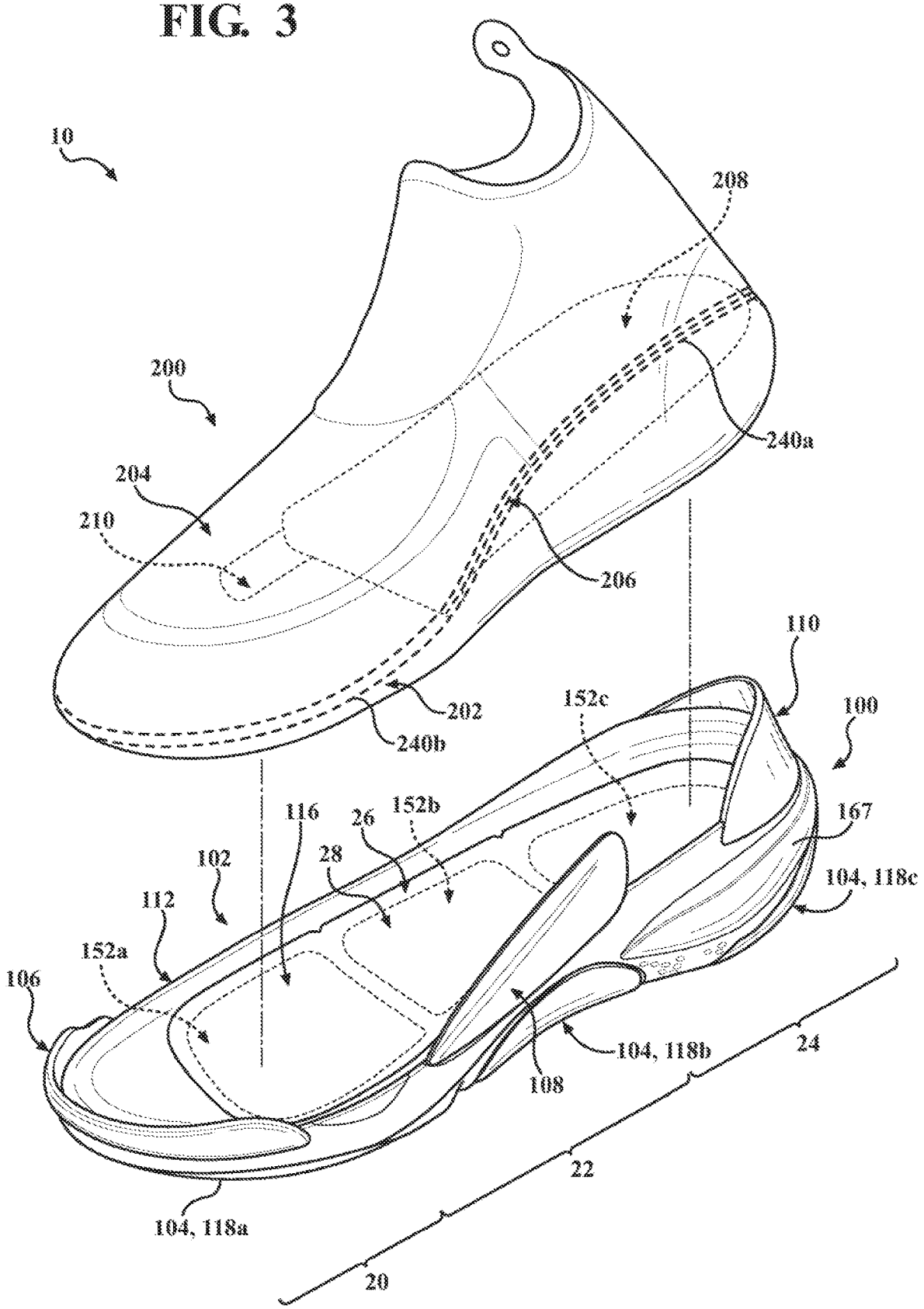
FIG. 3 is an exploded perspective view of the article of footwear of FIG. 1, showing a sole structure and a bootie of the article of footwear.

The article of footwear 10 may be further described as including a peripheral region 26 and an interior region 28, as indicated in FIG. 3. The peripheral region 26 is generally described as being a region between the interior region 28 and an outer perimeter of the sole structure 100. Particularly, the peripheral region 26 extends from the forefoot region 20 to the heel region 24 along each of the medial side 16 and the lateral side 18, and wraps around each of the anterior end 12 and the posterior end 14. The interior region 28 is circumscribed by the peripheral region 26, and extends from the forefoot region 20 to the heel region 24 along a central portion of the sole structure 100. Accordingly, each of the forefoot region 20, the mid-foot region 22, and the heel region 24 may be described as including the peripheral region 26 and the interior region 28.

Components of the article of footwear 10 may be further defined in terms of a vertical position on the article of footwear 10. For example, the article of footwear 10 includes a plantar region 30 on the bottom of the article of footwear 10 and configured to oppose or support a plantar surface of the foot. A dorsal region 32 is formed on an opposite side of the article 10 from the plantar region 30, and extends along a top side of the article of footwear 10 and receives a dorsal portion of the foot. A side region 34 extends along the medial side 16 and the lateral side 18 between the plantar region 30 and the dorsal region 32 and surrounds an outer periphery of the foot.

Figure 4:
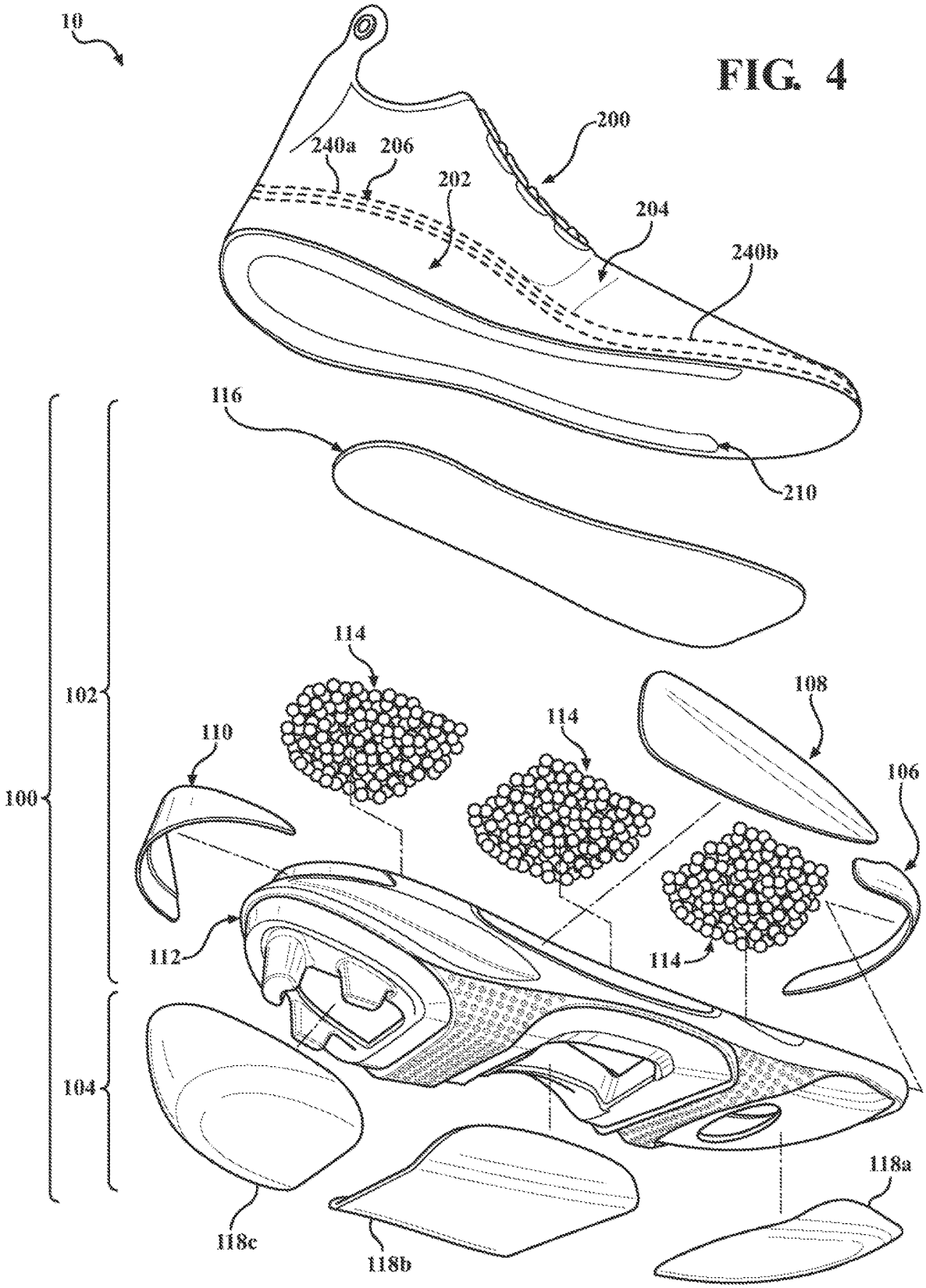
FIG. 4 is an exploded bottom perspective view of the article of footwear of FIG. 1, showing the sole structure exploded from the bootie.

With reference to FIG. 4, the sole structure 100 includes a midsole 102 configured to impart properties of cushioning and responsiveness, and an outsole 104 configured to impart properties of traction and abrasion resistance. The midsole 102 and the outsole 104 may cooperate to define a ground engaging surface 36 along the plantar region 30 of the article of footwear 10. The sole structure 100 may further include one or more directional supports, such as a toe cap 106 disposed at the anterior end 12 of the midsole 102, a saddle 108 extending from the medial side 18 of the midsole 102, and a heel clip 110 extending from the posterior end 14 of the midsole 102. As detailed below, the midsole 102 includes a cushioning element 112, a plurality of cushioning particles 114 received by the cushioning element 112, and an upper barrier layer 116 attached to the top of the cushioning element 112 to enclose the cushioning particles 114 on a first side of the cushioning element 112. The outsole 104 may include a plurality of outsole elements **118*a*-118*c* attached to an opposite side of the cushioning element 112 from the upper barrier layer 116 to enclose the cushioning particles 114 within the midsole 102**.

Referring to FIGS. 9-12, the cushioning element 112 of the midsole 102 extends from a first end 120 disposed at the anterior end 12 of the footwear 10 to a second end 122 disposed at the posterior end 14 of the footwear 10. The cushioning element 112 further includes a top surface 124 and a bottom surface 126 formed on an opposite side from the top surface 124. A distance between the top surface 124 and the bottom surface 126 defines a thickness of the cushioning element 112. An outer side surface 128 extends from the top surface 124 to the bottom surface 126 and defines an outer peripheral profile of the cushioning element 112.

The cushioning element 112 further includes an inner side surface 130 spaced inwardly from the outer side surface 128 and extending continuously from the top surface 124 to the bottom surface 126 to form a channel 132 through the thickness of the cushioning element 112. As shown, the inner side surface 130 is formed between the peripheral region 26 and the interior region 28 in the forefoot region 20, the midfoot region 22, and the heel region 24. Accordingly, the channel 132 is substantially formed within the interior region 28 of the cushioning element 112, and extends continuously from a first end 134 in the forefoot region 20 to a second end 136 in the heel region 24. In the illustrated example, the first end 134 is disposed between the toe portion $\mathbf{20}_T$ and a ball portion $\mathbf{20}_B$ of the forefoot region 20, such that the channel 132 extends through the ball portion $\mathbf{20}_B$, and the toe portion $\mathbf{20}_B$ is supported by the top surface 124 of the cushioning element 112. Accordingly, the top surface 124 of the cushioning element 112 extends along the peripheral region 26 in the forefoot region 20, the midfoot region 22, and the heel region 24. In other examples, the channel 132 may extend through the entire forefoot region 20, such that the toe portion $\mathbf{20}_T$ is also supported by the cushioning particles 114 when the sole structure 100 is assembled.

The cushioning element 112 includes one or more ribs **138*a*, 138*b* configured to separate the channel 132 into a plurality of pockets 152*a*-152*c* for receiving the cushioning particles 114. In the illustrated example, the one or more ribs 138*a*, 138*b* includes a first rib 138*a* disposed between the forefoot region 20 and the midfoot region 22, and a second rib 138*b* disposed between the midfoot region 22 and the heel region 24. In other examples, the cushioning element 112 may include different numbers of the ribs 138*a*, 138*b*. For example, where the channel 132 extends along an entirety of the interior region 28 of the cushioning element 112, the cushioning element 112 may include three or more ribs to divide the channel 132** into four or more pockets. Here, at least one of the pockets may be disposed within the toe portion $\mathbf{20}_T$.

Figure 9:
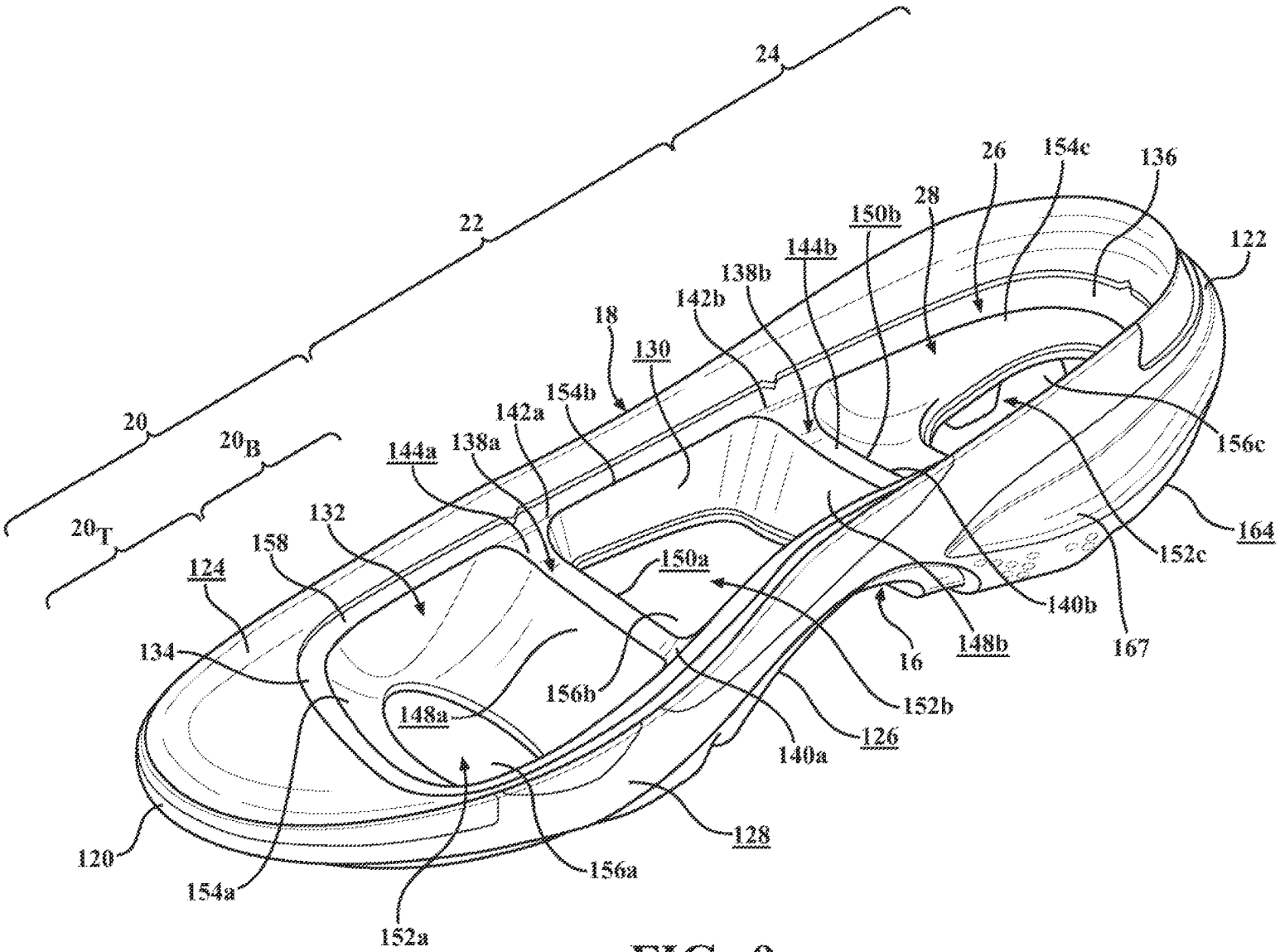
FIG. 9 is a top perspective view of a cushioning element of the article of footwear of FIG. 1.
Figure 10:
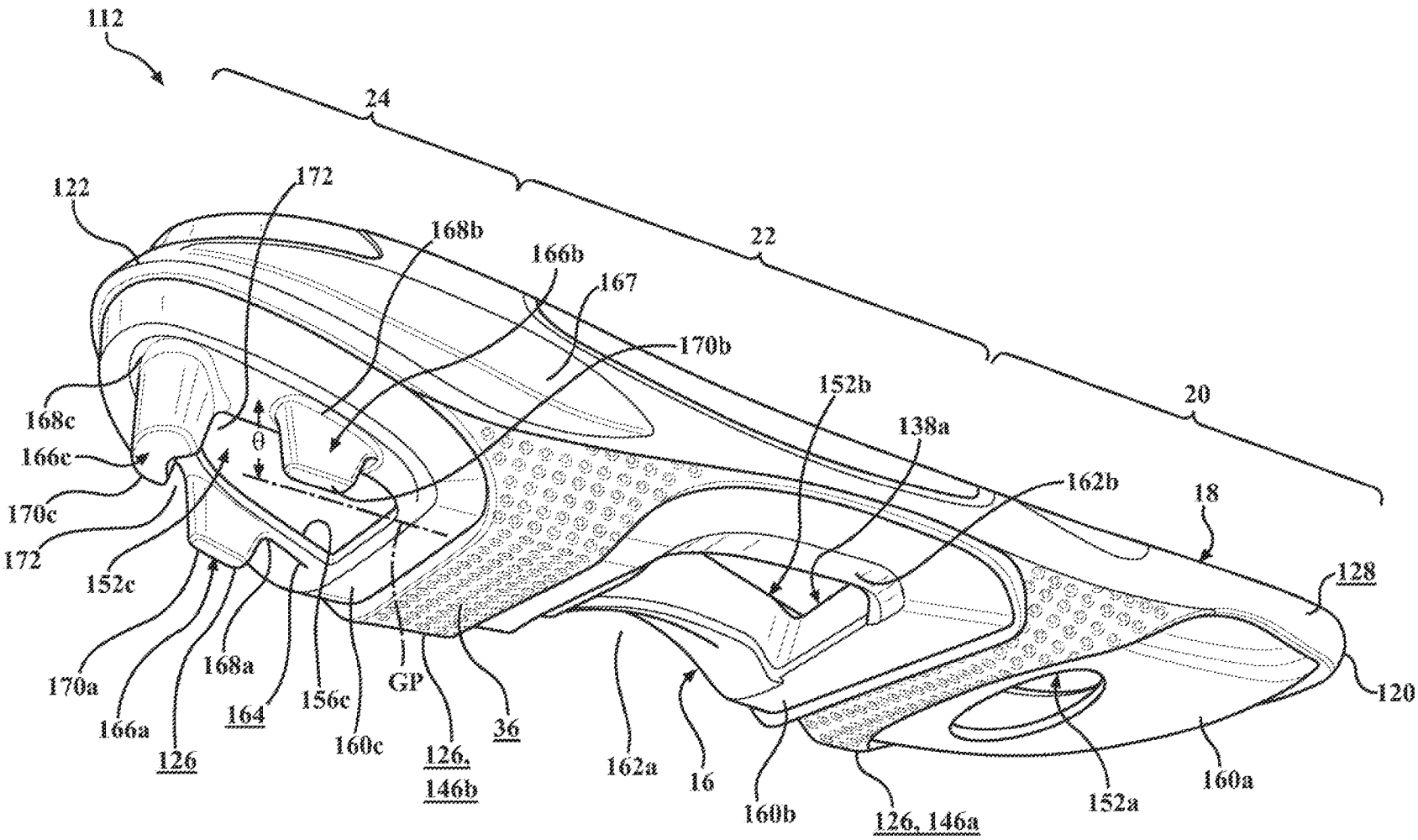
FIG. 10 is a bottom perspective view of the cushioning element of FIG. 9.

Each of the ribs 138*a*, 138*b* extends across the channel 132 from a first end 140*a*, 140*b* attached to the inner side surface 130 on the medial side 16 to a second end 142*a*, 142*b* attached to the inner side surface 130 on the lateral side 18. As shown in FIGS. 9 and 10, the ribs 138*a*, 138*b* further include an upper surface 144*a*, 144*b* formed at the top surface 124 of the cushioning element 112 and a lower surface 146*a*, 146*b* formed at the bottom surface 126 of the cushioning element 112. The upper surface 144*a*, 144*b* of each rib 138*a*, 138*b* may be offset or recessed from the top surface 124 of the cushioning element 112 by a distance. The lower surface 146*a*, 146*b* of each rib 138*a*, 138*b* may be coincident with the bottom surface 126 of the cushioning element 112, and form a portion of the ground-engaging surface 36 of the sole structure 100.

With reference to FIG. 7, each rib 138*a*, 138*b* may further include an anterior side surface 148*a*, 148*b* extending from the upper surface 144*a*, 144*b* towards the lower surface 146*a*, 146*b* and facing the anterior end 12, and a posterior side surface 150*a*, 150*b* extending from the upper surface 144*a*, 144*b* towards the lower surface 146*a*, 146*b* and facing the posterior end 14. A distance from the anterior side surface 146*a*, 146*b* to the posterior side surface 148*a*, 148*b* defines a width $W_{138a}$, $W_{138b}$ of each rib 138*a*, 138*b*. In the illustrated example, the widths $W_{138}$ of the ribs 138*a*, 138*b* increase along a direction from the upper surface 144*a*, 144*b* to the lower surface 146*a*, 146*b*. Accordingly each rib 138*a*, 138*b* is configured such that a stiffness progressively increases as compression towards the lower surface 146 increases. The anterior side surface 148*a* of the first rib 138*a* and the posterior side surface 148*b* of the second rib 138*b* may have concave profiles, while the posterior side surface 150*a* of the first rib 138*a* and the anterior side surface 148*b* of the second rib 138*b* may be substantially straight.

Referring again to FIGS. 9-12, the ribs 138*a*, 138*b* separate the channel 132 into a forefoot pocket 152*a* disposed on an anterior side of the first rib 138*a*, a midfoot pocket 152*b* disposed between the first rib 138*a* and the second rib 138*b*, and a heel pocket 152*c* disposed on a posterior side of the second rib 138*b*. Each of the forefoot pocket 152*a*, the midfoot pocket 152*b*, and the heel pocket 152*c* extends from a respective top opening 154*a*-154*c* formed through the top surface 124 to a bottom opening 156*a*-156*c* formed through the bottom surface 126. As discussed above, the widths $W_{138a}$, $W_{138b}$ of the ribs 138*a*, 138*b* may progressively increase in a direction from the top surface 124 to the bottom surface 126. Accordingly, a cross-sectional area of one or more of the pockets 152*a*-152*c* may progressively decrease along the direction from the top surface 124 to the bottom surface 126.

Figure 11:
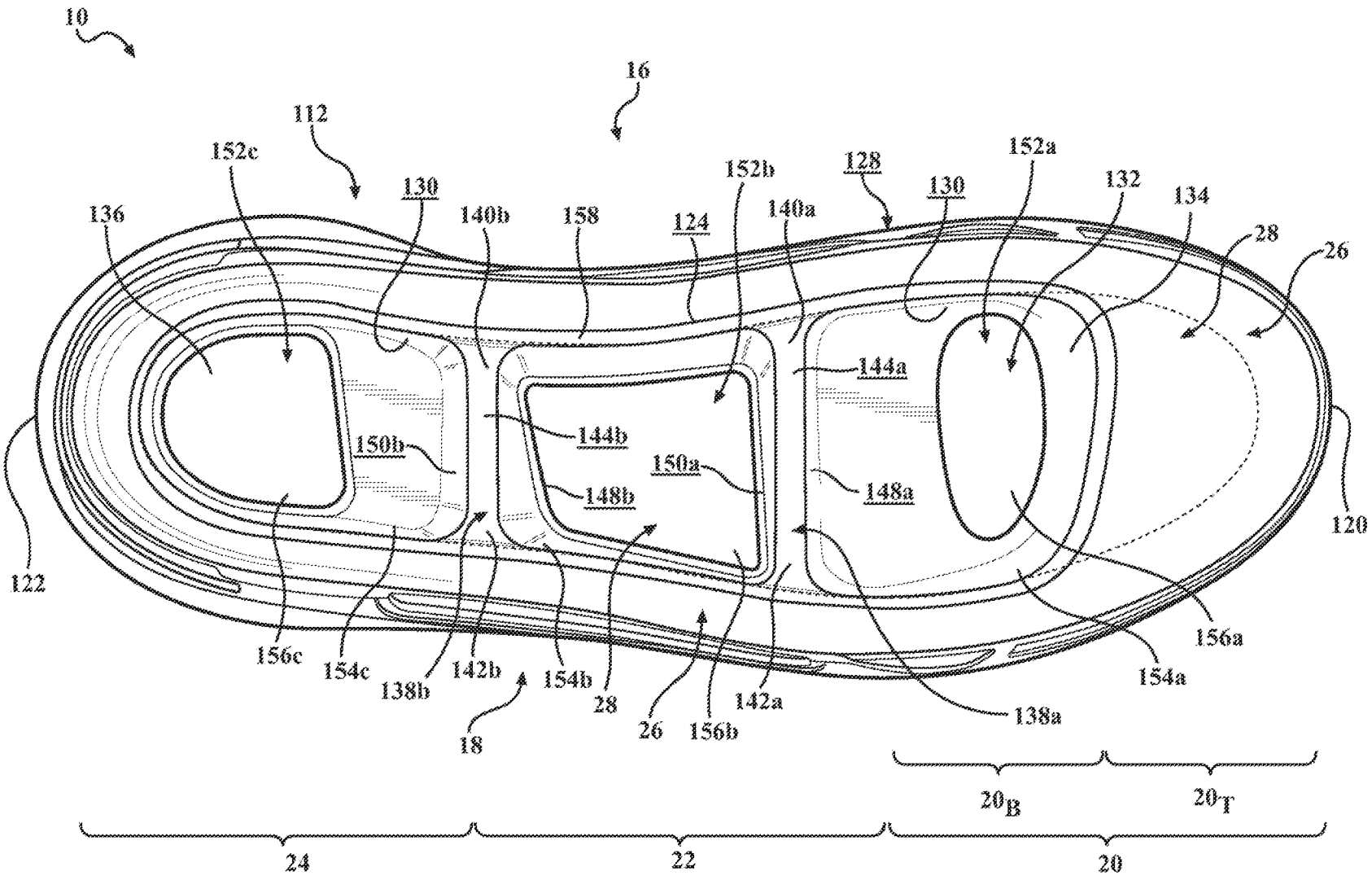
FIG. 11 is a top plan view of the cushioning element of FIG. 9.

With continued reference to FIGS. 9-12, the top surface 124 and the bottom surface 126 of the cushioning element 112 include a plurality of recesses for receiving covers or enclosures for the pockets 152*a*-152*c*. As shown in FIGS. 9 and 11, the top surface 124 includes a top recess 158 extending outwardly from the inner side surface 130 of the cushioning element 112. A peripheral profile of the top recess 158 corresponds to an outer peripheral profile of the upper barrier layer 116 and a depth of the top recess 158 corresponds to a thickness of the upper barrier layer 116. Accordingly, the top recess 158 is configured to receive the upper barrier layer 116 such that a top surface of the upper barrier layer 116 is substantially flush with the top surface 124 of the cushioning element 112 when the sole structure 100 is assembled, as shown in FIG. 7.

The bottom surface 126 of the cushioning element 112 further includes a plurality of outsole recesses 160*a*-160*c* corresponding to the bottom openings 156*a*-156*c* of each of the pockets 152*a*-152*c*. For example, each of the outsole recesses 160*a*-160*c* may extend outwardly from one of the bottom openings 156*a*-156*c* to provide a receptacle for receiving one of the outsole elements 118*a*-118*c*. Accordingly, the outsole recesses 160*a*-160*c* are configured with a depth corresponding to thicknesses of the respective outsole elements 118*a*-118*c*, while a peripheral profile of each outsole recess 160*a*-160*c* corresponds to a peripheral profile of one of the outsole elements 118*a*-118*c*.

With continued reference to FIG. 10, the cushioning element 112 may be provided with one or more windows 162*a*, 162*b* formed through the peripheral region 26 of the cushioning element 112 and into one of the pockets 152*a*-152*c*. For example, the cushioning element 112 includes a first pair of windows 162*a*, 162*b* formed in the bottom surface 126 and extending through the peripheral region 26 from the outer side surface 128 to the inner side surface 130. As shown, the windows 162*a*, 162*b* include a first window 162*a* extending into the midfoot pocket 152*b* on the medial side 16, and a second window 162*b* extending into the midfoot pocket 152*b* on the lateral side 18. Each of the windows 162*a*, 162*b* provides a space through with the cushioning particles 114 can flow between the cushioning element 112 and the outsole 104 when the sole structure 100 is assembled. Accordingly, cushioning particles 114 may be disposed against, and visible through, the midfoot outsole element 118*b* along the outer periphery of the sole structure 100.

Referring still to FIG. 10, the heel region 24 of the cushioning element 112 may include a ramp surface 164 formed around the bottom opening 156*c* of the heel pocket 152*c*. Generally, the ramp surface 164 extends in a direction from the bottom surface 126 towards the top surface 124, such that the ramp surface 164 is spaced apart from a ground plane GP in the heel region. As shown, the ramp surface 164 is formed at an oblique angle θ relative to the ground-engaging surface 36 of the sole structure 100, such that the ramp surface 164 extends away from the ground plane GP at the angle θ along a direction from the midfoot region 22 to the posterior end 14.

The heel region 24 of the cushioning element further includes one or more pillars 166*a*-166*c* projecting downwardly from the ramp surface 164. Accordingly, each of the pillars 166*a*-166*c* extends from a proximal end 168*a*-168*c* attached at the ramp surface 164 to a terminal, distal end 170*a*-170*c* formed at an opposite end of the pillar 166*a*-166*c*. The distal ends 170*a*-170*c* are configured to interface with the heel outsole element 118*c* when the sole structure 100 is assembled, thereby providing support to the article of footwear 10 in the heel region 24. Accordingly, the distal ends 170*a*-170*c* may by understood as forming a portion of the bottom surface 126 of the cushioning element 112. A cross-sectional area of one or more of the pillars 166*a*-166*c* may decrease along a direction from the proximal end 168*a*-168*c* to the distal end 170*a*-170*c*. For example, at least one of a width and/or a length of the one or more pillars 166*a*-166*c* may taper along a height direction from the proximal end 168*a*-168*c* to the distal end 170*a*-170*c*.

Figure 12:
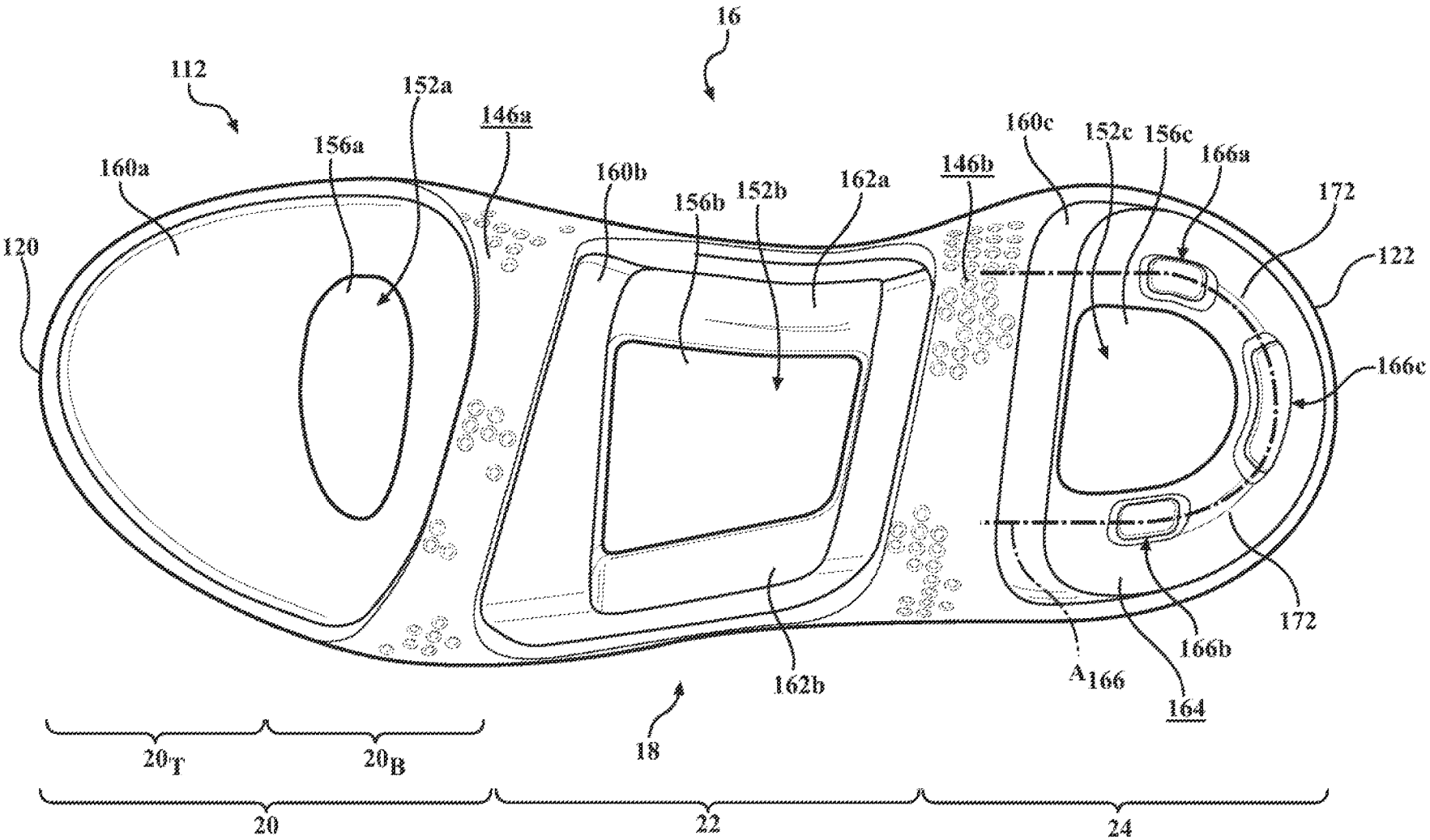
FIG. 12 is a bottom plan view of the cushioning element of FIG. 9.

In the illustrated example, the one or more pillars 166*a*-166*c* includes a series of pillars 166*a*-166*c* arranged around the bottom opening 156*c* of the heel pocket 152*c*. Particularly, the series of pillars 166*a*-166*c* includes a medial pillar 166*a* disposed on the medial side 16 of the bottom opening 156*c*, a lateral pillar 166*b* disposed on the lateral side 18 of the bottom opening 156*c*, and a posterior pillar 166*c* disposed on a posterior end of the bottom opening 156*c*. As shown in FIG. 12, the pillars 166*a*-166*c* are aligned in series along an outer periphery of the bottom opening 156*c*. Here, the pillars 166*a*-166*c* are arranged in series along a horseshoe-shaped, arcuate path or axis $A_{166}$ corresponding to the curvature of the posterior end 14 of the sole structure 100. The pillars 166*a*-166*c* may be spaced apart from each other along the axis $A_{166}$ to provide a series of gaps 172 between adjacent pillars 166*a*-166*c*. These gaps 172 maximize flow of the cushioning particles 114 within the heel region 24, as the cushioning particles 114 are able to flow freely between adjacent ones of the pillars 166*a*-166*c*.

In some examples, the heel region 24 of the cushioning element may include a relief 167 formed in the outer side surface 128. The relief 167 extends continuously around the heel region 24 from a first end on the medial side 16 to a second end on the lateral side 18. The relief 167 is configured to allow the peripheral region 26, and particularly, the outer side surface 128, to act as a spring or living hinge, thereby allowing the cushioning element 112 to compress in the heel region 24.

The cushioning element 112 is formed of one or more resilient polymeric materials, such as foam or rubber, to impart properties of cushioning, responsiveness, and energy distribution to the foot of the wearer. In the illustrated example, the cushioning element 112 is formed as a composite, whereby different components of the cushioning element 112 are formed of different materials to impart different properties to the sole structure 100. For example, the peripheral region 26 of the cushioning element 112 may be formed of a first polymeric material having a first durometer, while the ribs 138*a*-138*b*, or at least a top portion of the ribs 138*a*-138*b*, are formed of a second polymeric material having a lower durometer than the peripheral region 26. Accordingly, the ribs 138*a*-138*b* can be more easily compressed, and will provide a softer feel along the footbed to minimize point loads along the plantar surface of the foot.

Example resilient polymeric materials for the cushioning element 112 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer)

of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The outsole 104 may include one or more discrete outsole elements 118*a*-118*c* that are separate from one another. The outsole elements 118*a*-118*c* may be formed from a transparent or translucent material. The outsole elements 118*a*-118*c* may be formed from a durable material such as, for example, rubber and may be attached to the bottom surface 126 of the cushioning element 112 at the respective recesses 160*a*-160*c*. Accordingly, the outsole elements 118*a*-118*c* may be attached to the bottom surface 126 of the cushioning element 112 proximate to the bottom openings 156*a*-156*c* respectively associated with the first pocket 152*a*, the second pocket 152*b*, and the third pocket 152*c*. Optionally, one or more of the outsole elements 118*a*-118*c* may include perforations formed therethrough, thereby allowing air to move into the channel 132 through the outsole 104 as the cushioning particles 114 within the sole structure 100 are compressed or decompressed.

The outsole elements 118*a*-118*c* may be separated from one another along a length of the sole structure 100 in a direction substantially parallel to the longitudinal axis $L_{10}$. While the outsole 104 is described and shown as including individual portions that are spaced apart from one another, the outsole 104 could alternatively have a unitary construction that extends generally across the entire bottom surface 126 of the cushioning element 112 such that the outsole 104 extends continuously between the anterior end 12 and the posterior end 14 and between the medial side 16 and the lateral side 18. Regardless of the particular construction of the outsole 104 (i.e., unitary or discrete portions), the outsole 104 may include treads that extend from the outsole 104 to provide increased traction with a ground surface during use of the article of footwear 10.

Forming the outsole 104 from a transparent or translucent material allows the pockets 152*a*-152*c* to be viewed through the outsole 104 when the outsole 104 is attached to the cushioning element 112 at the bottom surface 126. Further, because the cushioning particles 114 substantially fill the respective pockets 152*a*-152*c*, the interiors of the pockets 152*a*-152*c* and, thus, the cushioning particles 114 disposed therein are likewise visible at the bottom openings 156*a*-156*c* of the cushioning element 112 through the material of the outsole 104. Accordingly, the cushioning particles 114 residing within the respective pockets 152*a*-152*c* of the cushioning element 112 are visible through the outsole 104 at the bottom openings 156*a*-156*c*.

Figure 5:
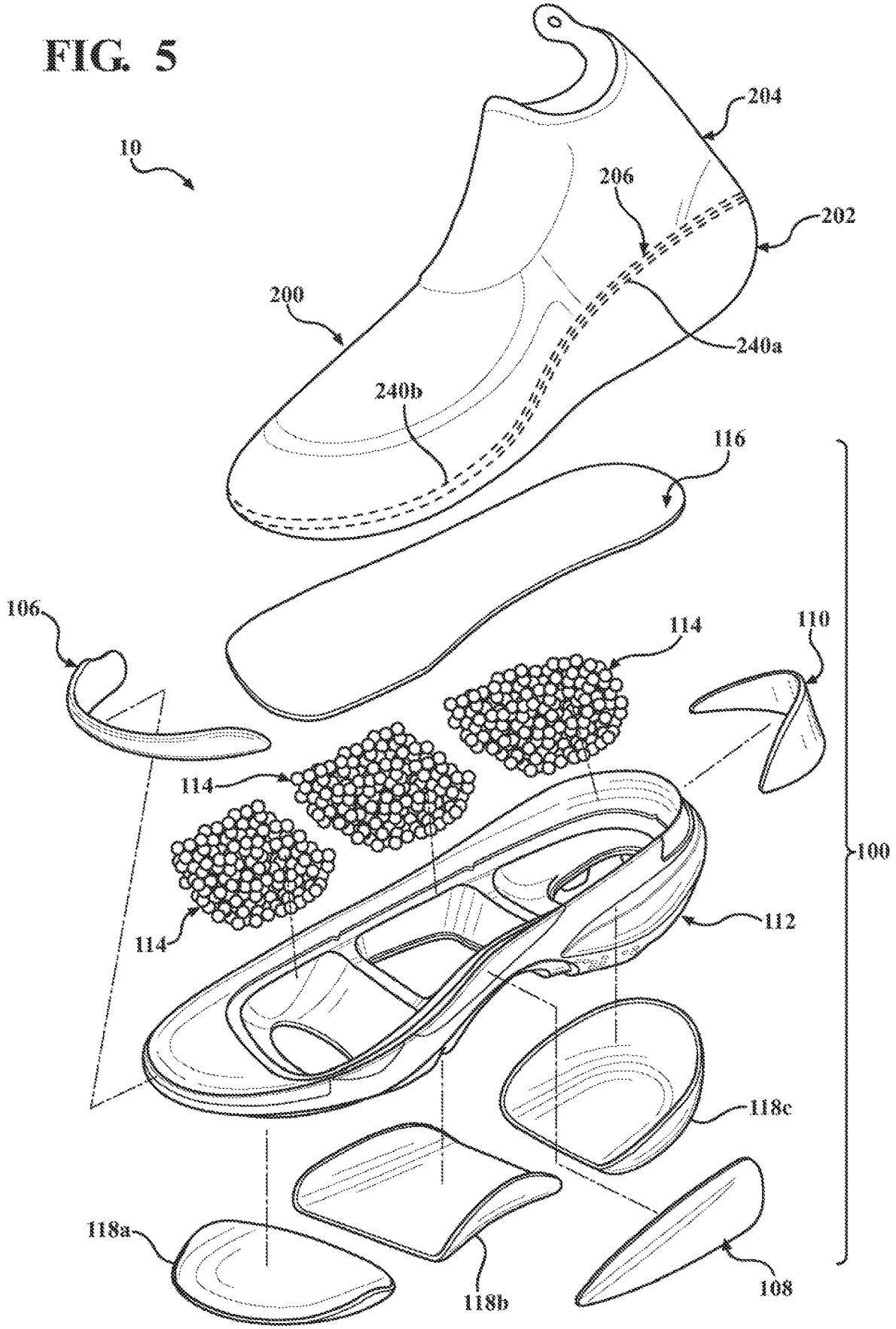
FIG. 5 is an exploded top perspective view of the article of footwear of FIG. 1, showing the sole structure exploded from the bootie.

With reference to FIGS. 5 and 7, the sole structure 100 includes volumes of the cushioning particles 114 disposed directly within each of the pockets 152*a*-152*c*. In other words, the cushioning particles 114 are not contained within an intermediate chamber or container, but are loosely disposed within each of the pockets 152*a*-152*c*. As shown in FIG. 7, each of the pockets 152*a*-152*c* is over-filled with a volume of the cushioning particles 114, such that the volume of cushioning particles 114 in each of the pockets 152*a*-152*c* extends above the upper surfaces 144*a*, 144*b* of the respective ribs 138*a*, 138*b*. Accordingly, the cushioning particles 114 will cooperate with the top surface 124 of the cushioning element 112 to support the plantar surface of the foot.

Regardless of the volume of the cushioning particles 114 disposed within the respective pockets 152*a*-152*c*, the cushioning particles 114 may be used to enhance the functionality and cushioning characteristics of the sole structure 100. The cushioning particles 114 contained within the pockets 152*a*-152*c* may include polymeric beads. For example, the cushioning particles 114 may be formed of any one of the resilient polymeric materials discussed above with respect to the cushioning element 112. In some examples, the cushioning particles 114 are formed of a foamed polyurethane (TPU) material, and have a substantially spherical shape. The foam beads defining the cushioning particles 114 may have approximately the same size and shape or, alternatively, may have at least one of a different size and shape. Regardless of the particular size and shape of the cushioning particles 114, the cushioning particles 114 cooperate with the cushioning element 112 and the outsole 104 to provide the article of footwear 10 with a cushioned and responsive performance during use.

With reference to FIG. 7, the upper barrier layer 116 is received within the top recess 158 of the cushioning element 112 to enclose the cushioning particles 114 within each of the respective pockets 152*a*-152*c*. Accordingly, the upper barrier layer 116 cooperates with the top surface 124 of the cushioning element 112 to form a support surface of the sole structure 100. The upper barrier layer 116 is formed of an air-permeable material, thereby allowing air to move in and out of the respective pockets 152*a*-152*c* as the cushioning particles 114 move between compressed and relaxed states. In some examples, the upper barrier layer 116 is formed of a knitted fabric material having a relatively high modulus of elasticity to allow the upper barrier layer 116 to stretch into the pockets 152*a*-152*c* when the sole structure 100 is compressed by the foot during use.

Incorporation of the cushioning particles 114 into the article of footwear 10 provides a degree of comfort and cushioning to a foot of a user during use. For example, when a force is applied on the upper barrier layer during use of the article footwear by a foot of a user, the force causes the upper barrier layer 116 to flex and stretch, thereby allowing the foot of the user to engage and displace the cushioning particles 114 disposed within the pockets 152*a*-152*c*. Such movement of the upper barrier layer 116 also compresses a material of the cushioning element 112 generally surrounding the pockets 152*a*-152*c* which, in turn, absorbs forces associated with a walking or running movement.

The toe cap 106, the saddle 108, and the heel clip 110 are each formed of a polymeric material having a greater rigidity than the cushioning element 112, and extend upwardly from the outer side surface 128 to provide areas of additional support to the bootie 200. As shown, the toe cap 106 is attached at the anterior end 12 and extends around the toe portion $\mathbf{20}_T$ from the medial side 16 to the lateral side 18. The saddle 108 is attached at the lateral side 18 in the midfoot region 22. The heel clip 110 is attached at the posterior end 14 and extends around the heel region 24 from the medial side 16 to the lateral side 18.

Figure 13:
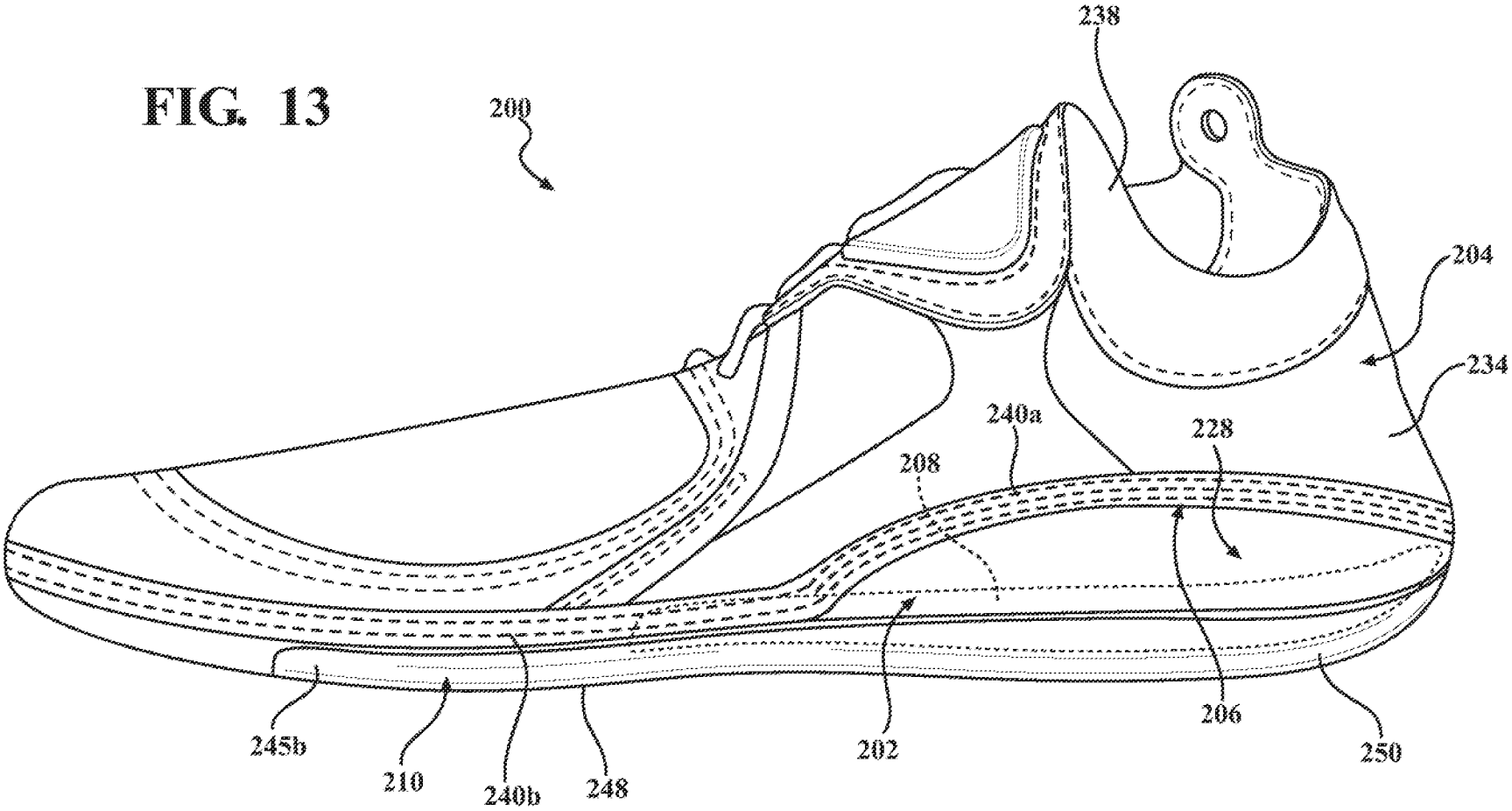
FIG. 13 is a lateral side elevation view of a bootie of the article of footwear of FIG. 1.
Figure 14:
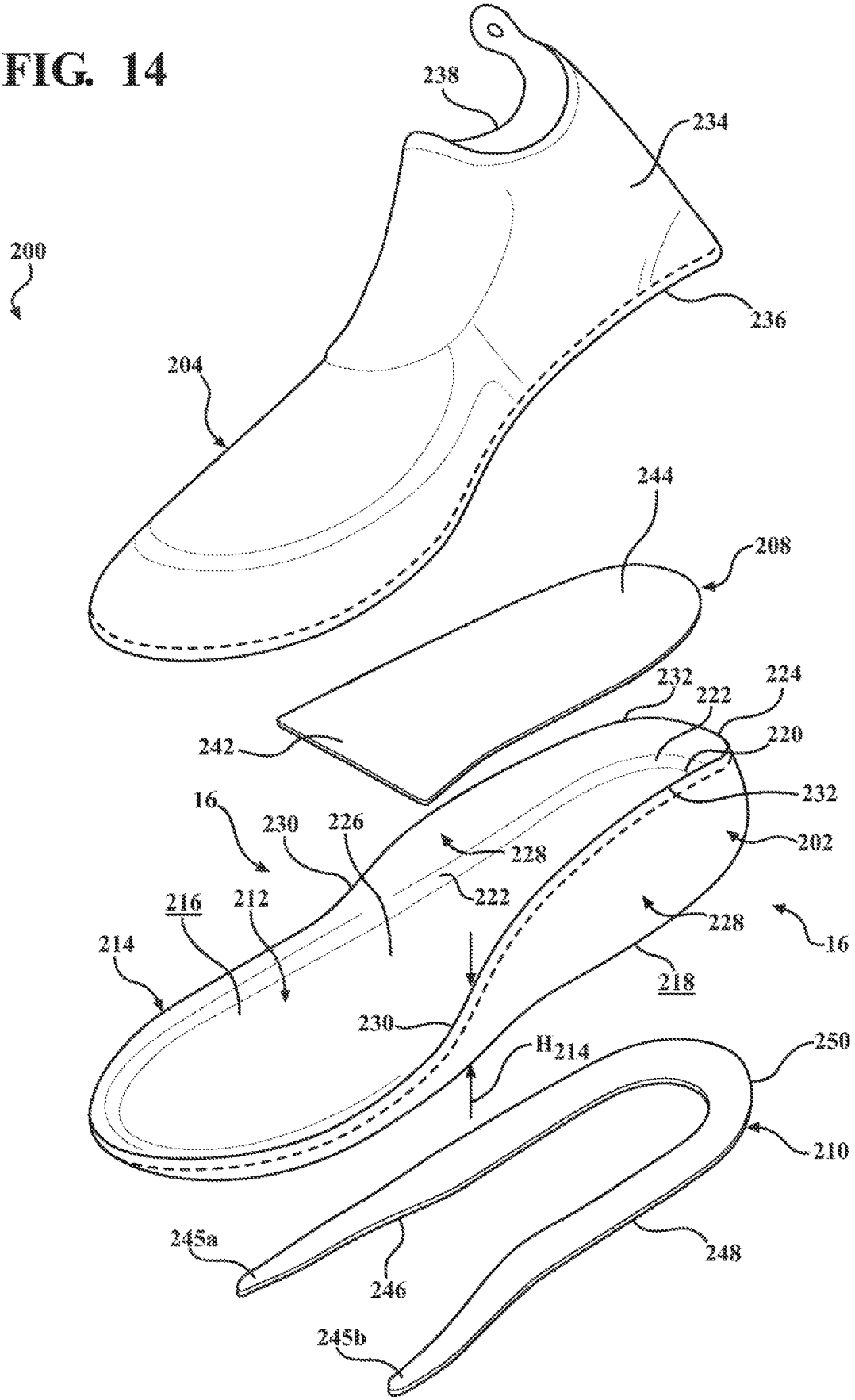
FIG. 14 is an exploded top perspective view of the bootie of FIG. 13.
Figure 15:
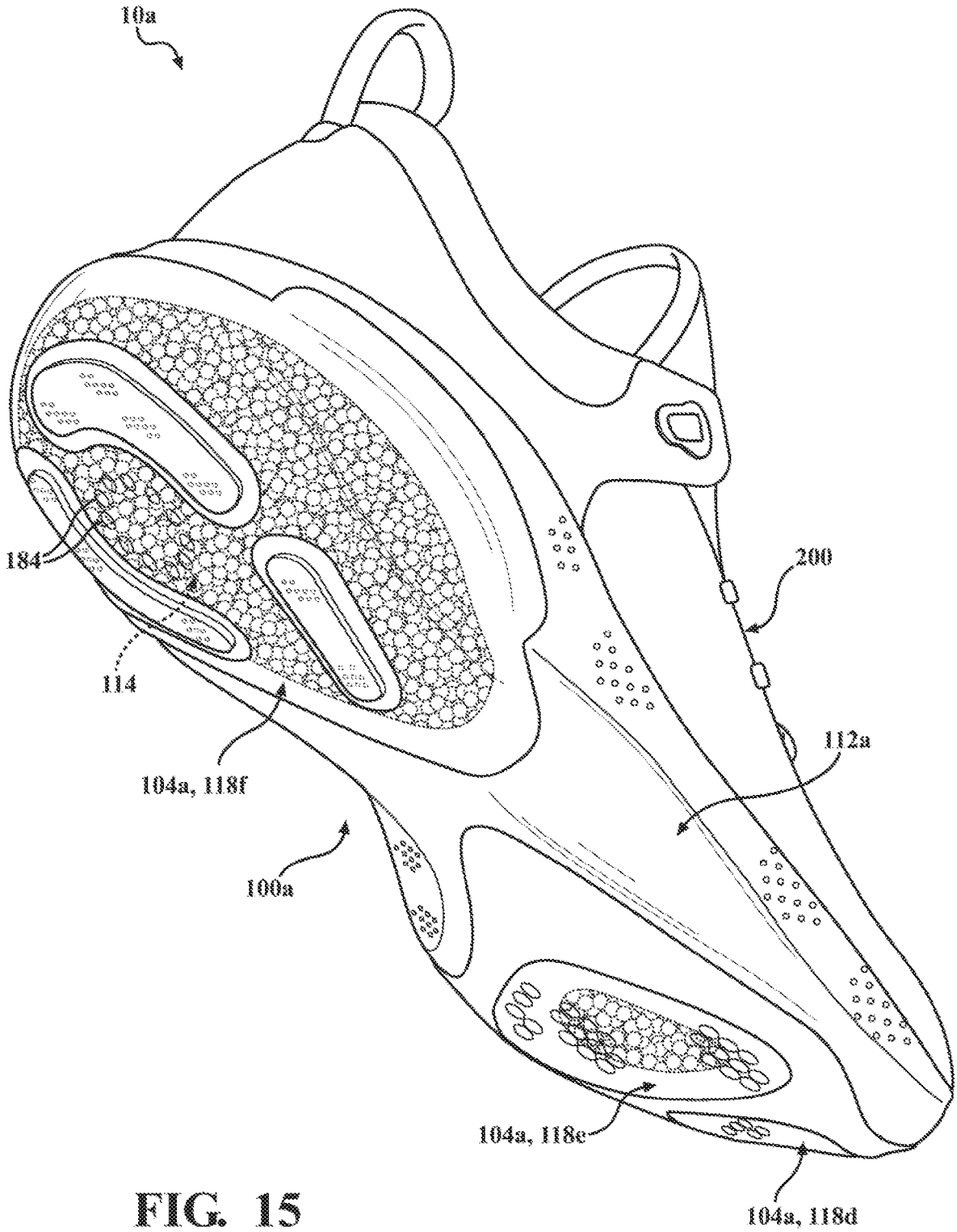
FIG. 15 is an bottom perspective view of an article of footwear in accordance with the principles of the present disclosure.

With particular reference to FIGS. 13 and 14, a bootie 200 for the article of footwear 10 is shown. As described in greater detail below, the bootie 200 may be formed from one or more materials that are stitched or adhesively bonded together to form the interior void configured to receive and secure a foot for support on the sole structure 100. Suitable materials of the bootie 200 may include, but are not limited to, mesh, textiles, foam, leather, and synthetic leather. The materials may be selected and located to impart properties of durability, air-permeability, wear-resistance, flexibility, and comfort.

In some examples the bootie 200 includes a strobel 202 and an upper 204 attached to an outer periphery of the strobel 202 along a peripheral seam 206 to define the interior void. For example, stitching or adhesives may secure the strobel 202 to the upper 204. An ankle opening is formed at the heel region 24 and may provide access to the interior void. For example, the ankle opening may receive a foot to secure the foot within the void and facilitate entry and removal of the foot to and from the interior void. In some examples, one or more fasteners extend along the upper 204 to adjust a fit of the interior void around the foot and to accommodate entry and removal of the foot therefrom. The fasteners may include laces, straps, cords, hook-and-loop, or any other suitable type of fastener.

As described in greater detail below and shown in FIG. 14, the bootie 200 further includes an interior reinforcement member 208 configured to be attached to an interior surface of the strobel 202, within the interior void. An exterior reinforcement member 210 is disposed on an opposite side of the strobel 202 from the interior reinforcement member 208, such that the exterior reinforcement member 210 opposes the sole structure 100 when the article of footwear 10 is assembled.

As shown in FIG. 14, the strobel 202 includes a footbed 212 and a peripheral wall 214 extending transversely (i.e., not parallel) from the footbed 212. The footbed 212 is substantially flat, but may be contoured to conform to a profile of the bottom surface (e.g., plantar) of the foot. The footbed 212 includes an interior surface 216 and an exterior surface 218 formed on an opposite side of the footbed 212 from the interior surface 216. The interior surface 216 is configured to enclose a bottom portion of the interior void and to support a plantar surface of the foot when the foot is disposed within the interior void. The exterior surface 218 is configured to oppose the sole structure 100, and may be attached to the top surface 124 of the cushioning element 112 and the upper barrier layer 116 when the bootie 200 is assembled to the sole structure 100. An outer periphery of the footbed 212 is defined by a peripheral edge 220, which corresponds to a peripheral profile of a plantar surface of a foot.

The peripheral wall 214 of the strobel 202 extends upwardly from a first end 222 attached to the peripheral edge 220 of the footbed 212 to a distal, upper terminal edge 224 spaced apart from the footbed 212. The peripheral edge 220 of the footbed 212 and the first end 222 of the peripheral wall 214 may cooperate to provide an arcuate or concave transition between a substantially flat portion of the footbed 212 and a substantially upright portion of the peripheral wall 214. As shown, the footbed 212 and the peripheral wall 214 cooperate to define a cavity 226 for receiving the foot. In some examples, the peripheral wall 214 may extend only partially around the peripheral edge 220 of the footbed 212 such that at least a portion of the peripheral edge 220 is exposed.

In the illustrated example, the peripheral edge 220 of the footbed 212 and the first end 222 of the peripheral wall 214 are integral, such that the footbed 212 and the peripheral wall 214 are formed as a substantially continuous piece having no pronounced seams. In some examples, the strobel 202 is formed of a single piece of flexible and/or elastic material. In other examples, the strobel 202 may be constructed of different materials having different properties, where the materials are joined to each other in a seamless manner to provide a substantially continuous and flush piece of material. By forming the strobel 202 with a substantially continuous and seamless structure, an underfoot feel of the article of footwear 10 is improved, as the plantar surface of the foot will not be exposed to pronounced, stiff regions associated with traditional stitched seams.

Figure 2:
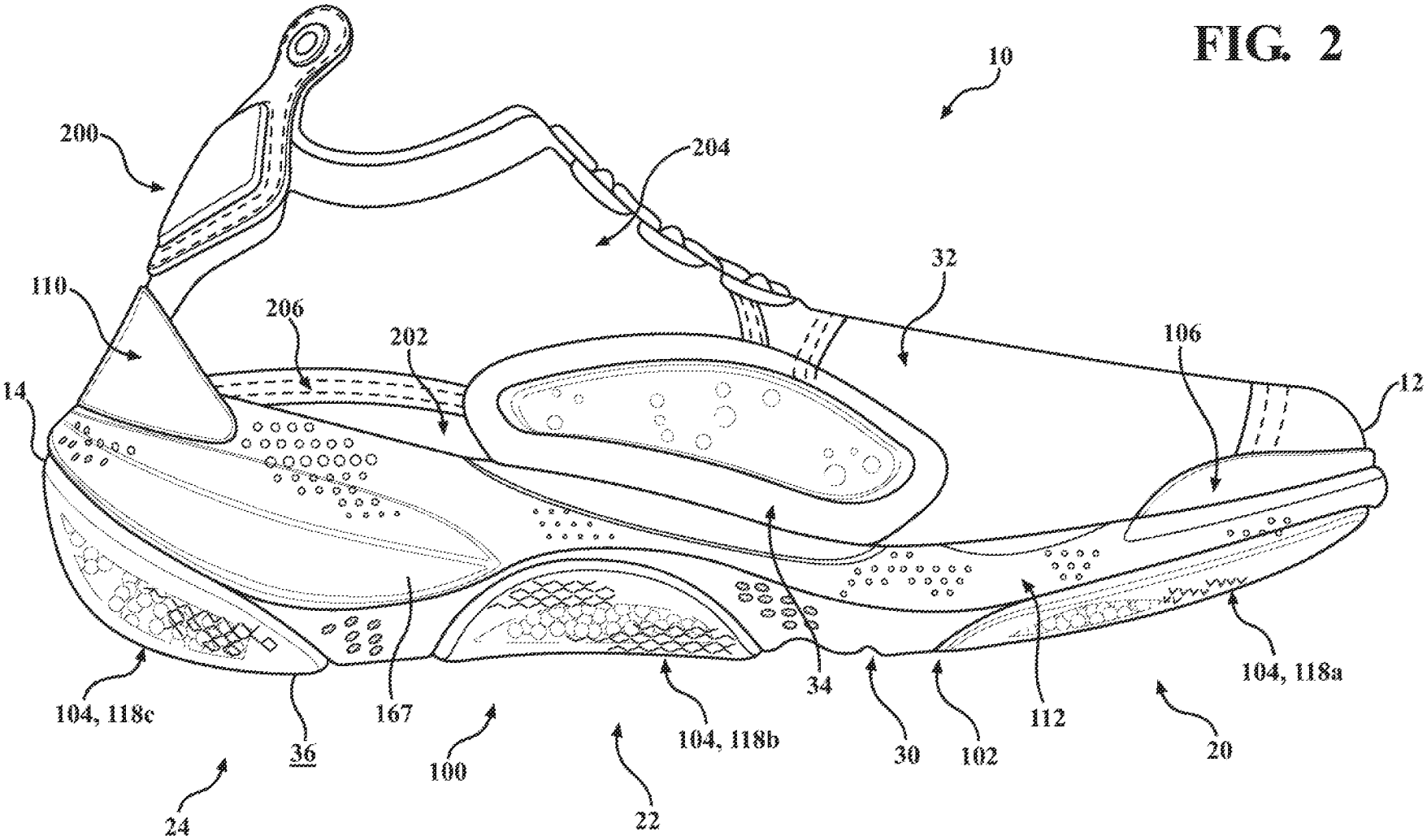
FIG. 2 is a medial elevation view of the article of footwear of FIG. 1.

A distance from the first end 222 of the peripheral wall 214 to the upper terminal edge 224 of the peripheral wall 214 defines a height $H_{214}$ of the peripheral wall 214 around the footbed 212. In some examples, the height $H_{214}$ of the peripheral wall 214 may be variable along the outer perimeter of the strobel 202. For example, the peripheral wall 214 may include one or more portions having a greater height $H_{214}$ than other portions. In the illustrated example, the peripheral wall 214 is formed with a pair of wings 228 extending from opposite sides of the footbed 212. A first one of the wings 228 extends from the medial side 16 of the footbed 212 and a second one of the wings 228 extends from the lateral side 18 of the footbed 212. Each of the wings 228 extends from a first end 230 in the midfoot region 22 to a second end 232 in the heel region 24. As shown in FIGS. 1 and 2, a height $H_{214}$ of the peripheral wall 214 along the wings 228 is selected so that when the article of footwear 10 is assembled, the wings 228 extend above a top edge of the sole structure 100. Accordingly, portions of the peripheral seam 206 extending along the wings 228 are exposed above the sole structure 100.

With continued reference to FIGS. 13 and 14, the upper 204 includes a sidewall 234 configured to surround a dorsal region of the foot when the article of footwear 10 is donned by the wearer. The sidewall 234 extends from a lower terminal edge 236 along the bottom of the upper 204 to a collar 238 defining the ankle opening at the top of the upper 204. As shown, a shape of the lower terminal edge 236 corresponds to the shape of the upper terminal edge 224 of the strobel 202, such that the lower terminal edge 236 can be mated with the upper terminal edge 224 to form the peripheral seam 206 when the bootie 200 is assembled.

The peripheral seam 206 extends continuously around the outer periphery of the bootie 200 to connect the strobel 202 to the upper 204. As discussed above, because the strobel 202 includes the peripheral wall 214, the peripheral seam 206 is positioned above the footbed 212, away from the plantar surface of the foot. More particularly, the peripheral seam 206 is arranged along sides 16, 18 of the bootie 200 in the midfoot region 22 so that vertical and lateral forces imparted on the sole structure 100 during movement are not applied to the peripheral seam 206 and the foot. Accordingly, the underfoot feel of the bootie 200 is improved.

The peripheral seam 206 may include a first stitching **240*a* in a first portion and a second stitching 240*b* in a second portion. For example, in the illustrated configuration, the peripheral seam 206 includes the first stitching 240*a* extending through the midfoot region 22 and around the heel region 24 and includes the second stitching 240*b* extending from the midfoot region 22 and around the forefoot region 20. The first stitching 240***a* may be an overlock stitching (e.g., surge stitching) and the second stitching may be a lock stitching (e.g., straight stitching).

With reference to FIG. 14, the bootie 200 includes the interior reinforcement member 208 and the exterior reinforcement member 210 attached to opposite sides of the footbed 212 from each other. The reinforcement members 208, 210 are each formed of a material having a greater stiffness than the material forming the footbed 212 of the strobel 202. Accordingly, the reinforcement members 208, 210 provide a desired degree of support and stability to the footbed 212. Each of the reinforcement members 208, 210 may be attached to the strobel 202 by adhesively bonding the reinforcement members 208, 210 to respective ones of the surfaces 216, 218 of the strobel 202.

The interior reinforcement member 208 is disposed on the interior surface 216 of the footbed 212 and extends continuously from a first end 242 disposed in the midfoot region 22 to a second end 244 at the posterior end 14. Likewise, the interior reinforcement member 208 extends continuously from the medial side 16 to the lateral side 18 of the footbed 212. Accordingly, the interior reinforcement member 208 is formed as a substantially continuous element covering the midfoot region 22 and the heel region 24 of the interior surface 216 of the footbed 212.

The exterior reinforcement member 210 is disposed on the exterior surface 218 of the footbed 212 and extends continuously from the forefoot region 20 to the posterior end 14. However, unlike the interior reinforcement member 208, which covers the peripheral region 26 and the interior region 28 of the footbed 212, the exterior reinforcement member 210 extends only along the peripheral region 26 of the exterior surface 218. Here, the exterior reinforcement member 210 is U-shaped or horseshoe shaped and extends along the peripheral region 26 from a first end 245*a* disposed in the forefoot region 20 on the medial side 16 to a second end 245*b* disposed in the forefoot region 20 on the lateral side 18. Accordingly, the exterior reinforcement member 210 includes a medial segment 246 extending along the peripheral region 26 on the medial side 16, a lateral segment 248 extending along the peripheral region on the lateral side 18, and a posterior segment 250 extending around the posterior end 14 and connecting the medial segment 246 and the lateral segment 248.

As discussed above, the components 202, 204, 208, 210 of the bootie 200 may be formed of different materials to provide desired characteristics. For example, the strobel 202 may be formed of a first material having first material properties and the upper 204 may be formed of one or more second materials having second material properties. In some instances, the first material forming the strobel 202 has as higher modulus of elasticity than the second material(s) forming the upper 204. Furthermore, the reinforcement members 208, 210 are formed of a third material having a greater stiffness than the material of the strobel 202.

With particular reference to FIGS. 15-18, an article of footwear 10*a* is provided and includes a sole structure 100*a* and the bootie 200 attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

Figure 16:
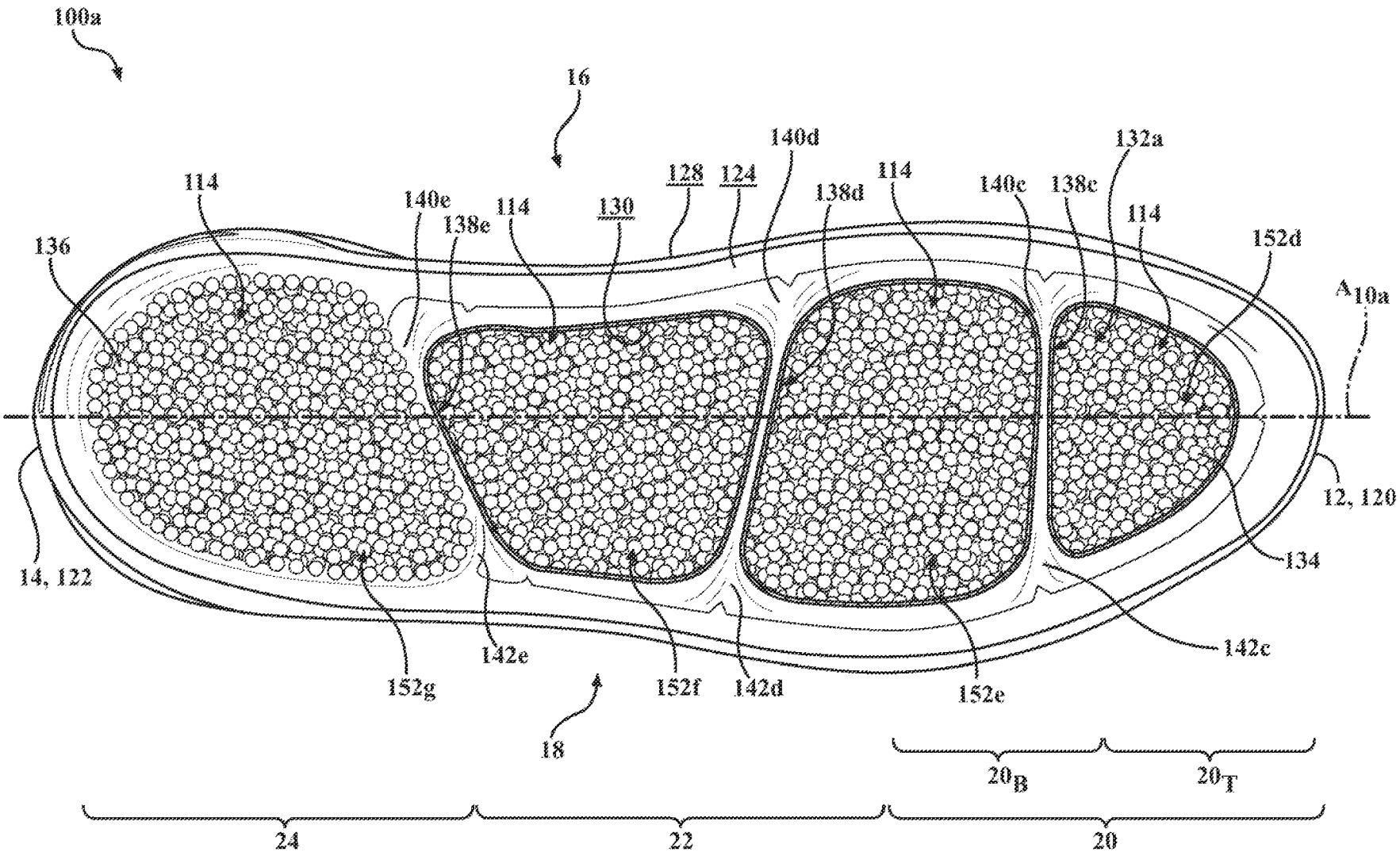
FIG. 16 is a top plan view of a sole structure of the article of footwear of FIG. 15.

As shown in FIG. 16, the midsole 102*a* of the sole structure 100*a* includes a cushioning element 112*a* that is configured differently than the cushioning element 112 discussed above. Particularly, the cushioning element 112*a* includes a channel 132*a* that extends along the entire length of the interior region 28 of the cushioning element 112*a*. Thus, the channel 132*a* extends from a first end 134 at the anterior end 12 of the cushioning element 112*a* to a second end 136 at the posterior end of the cushioning element 112*a*. As shown, the channel 132*a* is separated into four pockets 152*d*-152*g* by three ribs 138*c*-138*e* spaced along the length of the cushioning element 112*a*.

Each of the ribs extends from a first end 140*c*-140*e* attached to the inner side surface 130 on the medial side 16, to a second end 142*c*-142*e* attached to the inner side surface 130 on the lateral side 18. Likewise, each of the ribs 138*c*-138*e* includes an upper surface 144*c*-144*e* formed at the top surface 124 of the cushioning element 112*a* and a lower surface 146*c*-146*e* formed at the bottom surface 126 of the cushioning element 112*a*. The upper surface 144*a*-144*c* of each rib 138*c*-138*e* may be offset or recessed from the top surface 124 of the cushioning element 112*a* by a distance. The lower surface 146*c*-146*e* of each rib 138*c*-138*e* may be coincident with the bottom surface 126 of the cushioning element 112*a*, and may form a portion of the ground-engaging surface 36 of the sole structure 100*a*. Each rib 138*c*-138*e* may further include an anterior side surface 148*c*-148*e* extending from the upper surface 144*c*-144*e* towards the lower surface 146*c*-146*e* and facing the anterior end 12, and a posterior side surface 150*c*-150*e* extending from the upper surface 144*c*-144*e* towards the lower surface 146*c*-146*e* and facing the posterior end 14.

A first one of the ribs 138*c* is disposed between the toe portion $\mathbf{20}_T$ and the ball portion $\mathbf{20}_B$ of the forefoot region 20. A second one of the ribs 138*d* is disposed between the forefoot region 20 and the midfoot region 22, and a third one of the ribs 138*e* is disposed between the midfoot region 22 and the heel region 24. Accordingly, the ribs 138*c*-138*e* separate the channel 132*a* into a toe pocket 152*d*, a ball pocket 152*e*, a midfoot pocket, 152*f*, and a heel pocket 152*g*.

Referring to FIG. 16, the first rib 138*c* extends from the medial side 16 to the lateral side 18 at a substantially orthogonal angle to the longitudinal axis $A_{10a}$ of the article of footwear 10. The second rib 138*d* extends from the medial side 16 to the lateral side 18 at a first oblique angle to the longitudinal axis $A_{10a}$, such that the first end 144*d* is positioned closer to the anterior end 12 than the second end 146*d*. The third rib 138*e* extends from the medial side 16 to the lateral side 18 at a second oblique angle to the longitudinal axis $A_{10a}$, such that the first end 144*e* is disposed closer to the posterior end 14 than the second end 146*e*. Accordingly, the second rib 138*d* and the third rib 138*e* converge with each other along the direction from the medial side 16 to the lateral side 18.

Like the sole structure 100 discussed above, the sole structure 100*a* of FIGS. 15-18 may include the pillars 166*a*-166*c* arranged in series around the heel region 24. The pillars 166*a*-166*c* are spaced apart from each other by the gaps 172, thereby allowing the cushioning particles to migrate from the heel pocket 152*g* towards the outer side surface 128 of the cushioning element 112*a*.

Figure 17:
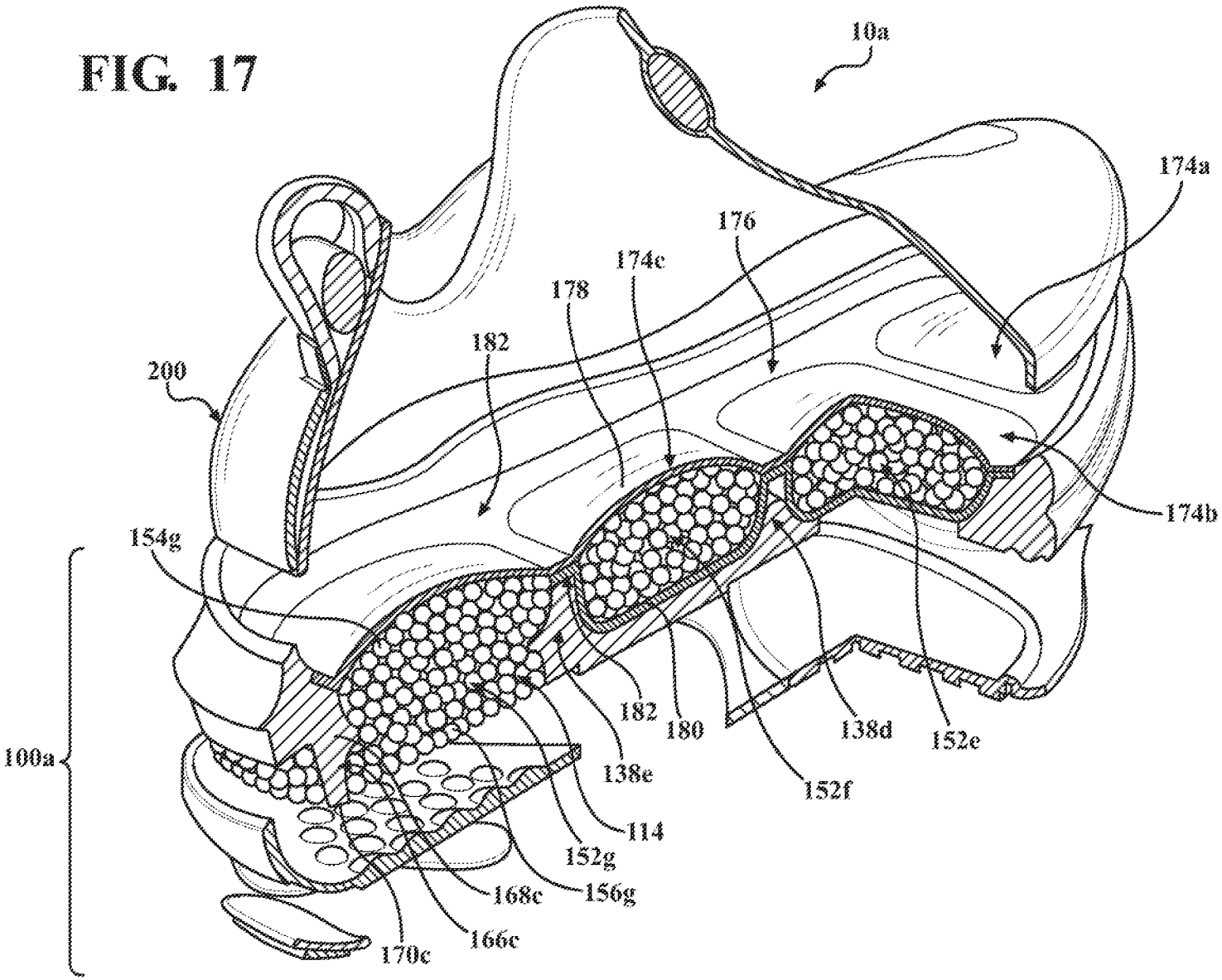
FIG. 17 is a cross-sectional view of the article of footwear of FIG. 15.
Figure 18:
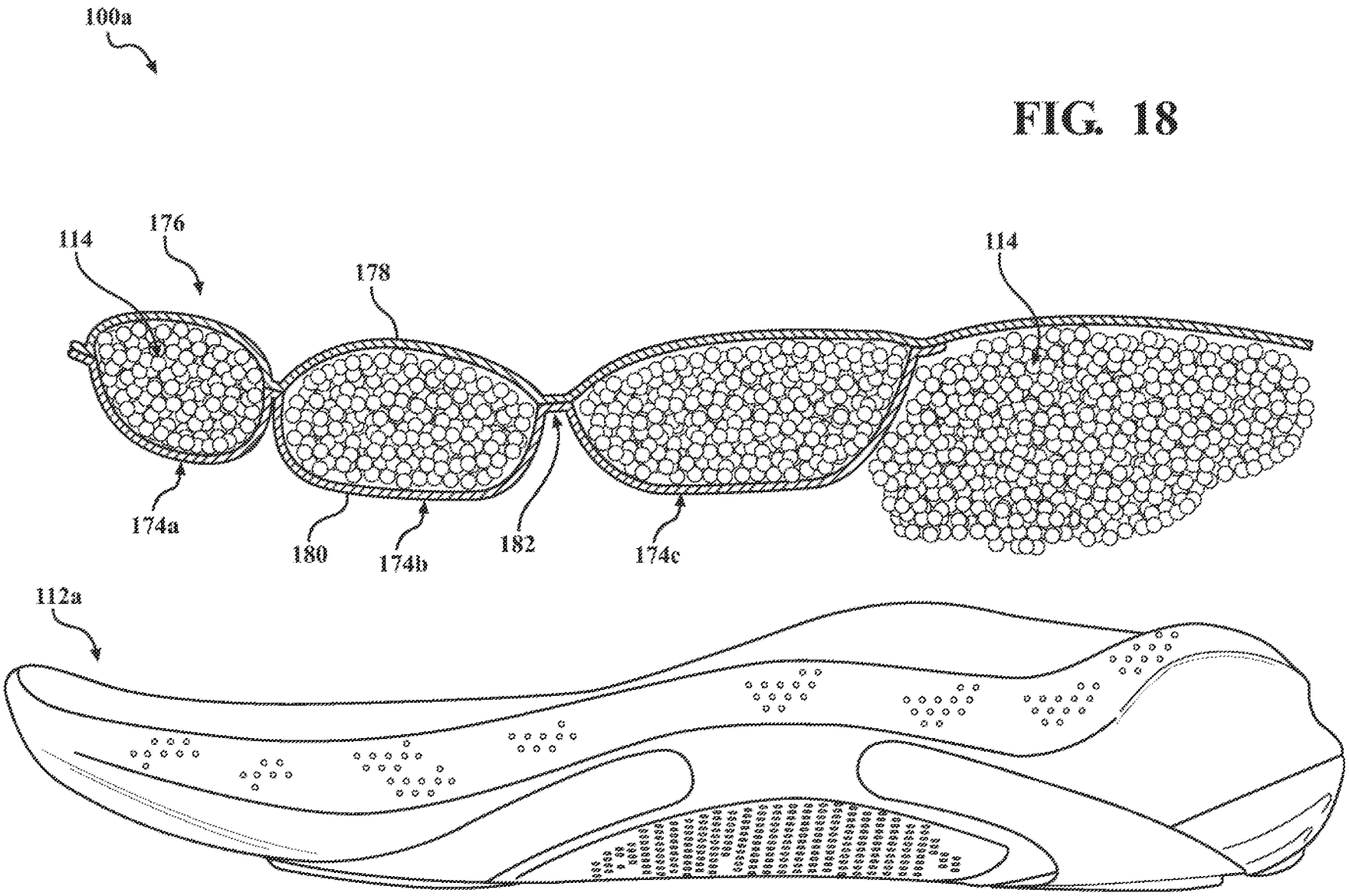
FIG. 18 is an exploded plan view of the sole structure of the article of footwear of FIG. 15.

With reference to FIG. 17, the cushioning particles 114 of the sole structure 100*a* may optionally be contained within one or more chambers 174*a*-174*c*, which are received within the pockets 152*d*-152*e*. In the illustrated example, the chambers 174*a*-174*c* are formed as part of a bladder 176 having the upper barrier layer 116 and a lower barrier layer 180 joined together with each other at discrete locations to define a web area 182 and the chambers 174*a*-174*c*. Accordingly, the chambers 174*a*-174*c* are all connected to each other by the web area 182. In other examples, one or more of the chambers 174*a*-174*c* may be formed separately from other ones of the chambers 174*a*-174*c*.

The upper barrier layer 116 and the lower barrier layer 180 may be formed from flexible materials that allow the lower barrier layer 180 and the upper barrier layer 116 to stretch and move during use of the article of footwear 10 when the sole structure 100 is subjected to a force from a foot of a user. In one configuration, the upper barrier layer 116 and the lower barrier layer 180 are formed from different materials. For example, the lower barrier layer 180 may be formed from a polymer material such as thermoplastic polyurethane (TPU). Forming the lower barrier layer 180 from TPU allows the lower barrier layer 180 to be formed from an impermeable material and, in some configurations, allows the lower barrier layer 180 to be formed from an optically clear and/or translucent material.

The upper barrier layer 116 may be formed from a flexible material such as, for example, spandex. Forming the upper barrier layer 116 from a flexible material such as spandex also allows the upper barrier layer 116 to be permeable. Forming the upper barrier layer 116 from a permeable material permits fluid communication through the upper barrier layer 116 into each of the chambers 174*a*-174*c*, thereby permitting air circulation from an area external to the bladder 176 into the chambers 174*a*-174*c*.

The upper barrier layer 116 may be attached to the lower barrier layer 180 via an adhesive. The adhesive may be a hot melt adhesive and may surround a perimeter of each of the chambers 174*a*-174*c*. As such, the adhesive joins the material of the upper barrier layer 116 to the material of the lower barrier layer 180 between each of the chambers 174*a*-174*c*, thereby defining an interior void within each chamber 174*a*-174*c* between the upper barrier layer 116 and the lower barrier layer 180.

Attaching the upper barrier layer 116 to the lower barrier layer 180 around a perimeter of each chamber 174*a*-174*c* such that the adhesive completely surrounds each chamber 174*a*-174*c* creates the web area 182 in areas where the upper barrier layer 116 is attached to the lower barrier layer 180. The web area 182 may extend between each chamber 174*a*-174*c* as well as around an outer perimeter of the bladder 176, as shown in FIG. 17. The web area 182 may include a thickness that is substantially equal to a depth of the top recess 158 of the cushioning element 112*a* relative to the top surface 124 of the cushioning element 112*a*. Further, the overall shape of the bladder 176 is defined by the web area 182 at a perimeter of the bladder 176 and may include a peripheral profile that is substantially the same as a peripheral profile of the top recess 158, as formed into the top surface 124. Accordingly, when the bladder 176 is inserted into the midsole, an upper surface of the bladder 176 is substantially flush with the top surface 124 of the cushioning element 112, thereby providing a uniform surface that receives the footbed 212 of the bootie 200. Providing a uniform surface that opposes the footbed 212 provides a degree of comfort to a foot of a user by preventing the user from feeling a transition or junction between the cushioning element 112 and the bladder 176.

With continued reference to FIG. 17, at least one of the pockets 152*d*-152*g* receives the cushioning particles 114 directly, without the cushioning particles 114 being contained within an intermediate chamber 174*a*-174*c*. In the illustrated example, the cushioning particles 114 are provided directly to the heel pocket 152*g*, such that the cushioning particles 114 are loosely contained within the heel pocket 152*g* by enclosing a bottom portion of the heel pocket 152*g* with the outsole 104*a* and enclosing a top portion of the heel pocket 152*g* with the upper barrier layer 116 of the bladder 176. Thus, while the lower barrier layer 180 terminates at the third rib 138*e*, the upper barrier layer 116 extends continuously to the posterior end 14 to cover the top opening 154*g* of the heel pocket 152*g*.

As with the outsole 104 of FIGS. 1-14, the outsole 104*a* includes a plurality of outsole elements 118*d*-118*f* attached to the bottom surface 126 of the cushioning element 112*a* to enclose the bottom openings 156*d*-156*g* of the pockets 152*d*-152*g*. Here, one or more of the pockets 152*d*-152*g* may not include a bottom opening and, therefore, no outsole element is associated with the pocket. For example, as shown in FIG. 17, the midfoot pocket 152*f* does not include a bottom opening, such that the lower portion of the midfoot pocket 152*f* is fully enclosed by the cushioning element 112*a*. Thus, the outsole 104*a* includes a toe outsole element 118*d*, a ball outsole element 118*e*, and a heel outsole element 118*f*.

Optionally, one or more of the outsole elements 118*d*-118*f* may have perforations 184 formed therethrough, which allow air to move in and out of the pockets 152*d*-152*g* when the cushioning particles 114 are compressed. In the illustrated example, the perforations 184 are formed in the heel outsole element 118*f* to allow air to move in and out of the heel pocket 152*g*. In contrast, perforations are unnecessary in the outsole elements 118*d*, 118*e* associated with the pockets 152*d*, 152*e* having the impermeable lower barrier layer 180, as air would be unable to move through the lower barrier layer 180.

The following Clauses provide exemplary configurations of the sole structure and article of footwear described above.

Clause 1. A sole structure for an article of footwear comprises a cushioning element having a top surface, a bottom surface formed on an opposite side of the cushioning element from the top surface, a ramp surface spaced apart from the bottom surface in a heel region of the cushioning element, a heel pocket extending through the cushioning element from the top surface to the ramp surface, and a plurality of pillars extending from the ramp surface and surrounding the pocket. A plurality of cushioning particles is disposed within the pocket, an outsole is attached to the cushioning element and encloses a first end of the pocket, and an upper barrier layer is attached to the top surface of the cushioning element and covers a second end of the pocket.

Clause 2. The sole structure of Clause 1, wherein the plurality of pillars are arranged along an arcuate path in the heel region.

Clause 3. The sole structure of any of the preceding clauses, wherein each of the pillars extends from a first end attached to the ramp surface to a terminal end aligned with the bottom surface.

Clause 4. The sole structure of any of the preceding clauses, wherein a cross-sectional area of at least one of the pillars tapers in a direction away from the ramp surface.

Clause 5. The sole structure of any of the preceding clauses, wherein the pillars are spaced inwardly from an outer periphery of the cushioning element.

Clause 6. The sole structure of any of the preceding clauses, wherein at least one of the pillars is arcuate.

Clause 7. The sole structure of any of the preceding clauses, wherein the heel pocket includes a bottom opening formed through the ramp surface.

Clause 8. The sole structure of Clause 7, wherein the plurality of pillars are arranged around the bottom opening.

Clause 9. The sole structure of any of the preceding clauses, wherein cushioning element further includes a midfoot pocket and at least one forefoot pocket.

Clause 10. The sole structure of Clause 9, wherein cushioning element includes a first rib disposed between the at least one forefoot pocket and the midfoot pocket, and a second rib disposed between the midfoot pocket and the heel pocket.

Clause 11. The sole structure of Clause 10, wherein each of the first rib and the second rib extends from a first end attached to a medial side of the cushioning element to a second end attached to a lateral side of the cushioning element.

Clause 12. The sole structure of any of Clauses 10 or 11, wherein each of the ribs extends from an upper surface formed at the top surface of the cushioning element to a lower surface formed at the bottom surface of the cushioning element.

Clause 13. The sole structure of Clause 12, wherein the upper surface is recessed from the top surface of the cushioning element, and the lower surface is coincident with the bottom surface of the cushioning element.

Clause 14. The sole structure of any of Clauses 12 or 13, wherein the upper barrier layer is attached to the top surface of the cushioning element and the upper surface of each of the ribs to enclose each of the pockets.

Clause 15. The sole structure of any of Clauses 10 to 14, wherein at least a portion of each of the ribs is formed of a first material having a lower durometer than a second material forming a peripheral region of the cushioning element.

Clause 16. The sole structure of any of the preceding clauses, wherein the outsole is formed of a transparent material.

Clause 17. The sole structure of any of the preceding clauses, wherein the outsole includes a plurality of outsole elements.

Clause 18 The sole structure of any of the preceding clauses, wherein the upper barrier layer is formed of a permeable material.

Clause 19. The sole structure of any of the preceding clauses, wherein the upper barrier layer is formed of a fabric material.

Clause 20. A sole structure for an article of footwear comprises a cushioning element having a top surface, a bottom surface, and a ramp surface disposed in a heel region and offset towards the top surface from the bottom surface, the cushioning element including a channel having a bottom opening formed through the ramp surface, and one or more pillars extending from the ramp surface and surrounding the bottom opening. An outsole is attached to the cushioning element and covers the bottom opening and each of the pillars and a plurality of cushioning particles is disposed within the channel and surrounds each of the pillars.

Clause 21. The sole structure of Clause 20, wherein the one or more pillars includes a plurality of pillars arranged along an arcuate path in the heel region.

Clause 22. The sole structure of any of the preceding clauses, wherein each of the pillars extends from a first end attached to the ramp surface to a distal end aligned with the bottom surface.

Clause 23. The sole structure of any of the preceding clauses, wherein a cross-sectional area of at least one of the pillars tapers in a direction away from the ramp surface.

Clause 24. The sole structure of any of the preceding clauses, wherein the pillars are spaced inwardly from an outer periphery of the cushioning element.

Clause 25. The sole structure of any of the preceding clauses, wherein at least one of the pillars is arcuate.

Clause 26. The sole structure of any of the preceding clauses, wherein the channel includes at least one forefoot pocket, a midfoot pocket, and a heel pocket.

Clause 27. The sole structure of Clause 26, wherein cushioning element includes a first rib disposed between the at least one forefoot pocket and the midfoot pocket, and a second rib disposed between the midfoot pocket and the heel pocket.

Clause 28. The sole structure of Clause 27, wherein each of the first rib and the second rib extends from a lateral end attached to a lateral side of the cushioning element to a medial end attached to a medial side of the cushioning element.

Clause 29. The sole structure of any of Clauses 27 or 28, wherein each of the ribs extends from an upper surface formed at the top surface of the cushioning element to a lower surface formed at the bottom surface of the cushioning element.

Clause 30. The sole structure of Clause 29, wherein the upper surface is recessed from the top surface of the cushioning element, and the lower surface is coincident with the bottom surface of the cushioning element.

Clause 31. The sole structure of any of Clauses 29 or 30, wherein the upper barrier layer is attached to the top surface of the cushioning element and the upper surface of each of the ribs to enclose the channel.

Clause 32. The sole structure of any of Clauses 27 to 31, wherein at least a portion of each of the ribs is formed of a first material having a lower durometer than a second material forming a peripheral region of the cushioning element.

Clause 33. The sole structure of any of the preceding clauses, wherein the outsole is formed of a transparent material.

Clause 34. The sole structure of any of the preceding clauses, wherein the outsole includes a plurality of outsole elements.

Clause 35. The sole structure of any of the preceding clauses, wherein the upper barrier layer is formed of a permeable material.

Clause 36. The sole structure of Clause 1, wherein the upper barrier layer is formed of a fabric material.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A sole structure for an article of footwear, the sole structure comprising:

a cushioning element having a top surface, a bottom surface formed on an opposite side of the cushioning element from the top surface and including a ramp surface spaced apart from the top surface in a heel region of the cushioning element, a heel pocket extending through the cushioning element from the top surface to the ramp surface to define a top opening at the top surface and a ramp opening at the ramp surface, and a plurality of pillars extending from the ramp surface and surrounding the heel pocket;

a plurality of cushioning particles disposed within the heel pocket;

an outsole attached to the cushioning element and enclosing a first end of the heel pocket; and an upper barrier layer attached to the top surface of the cushioning element and covering a second end of the heel pocket to enclose the plurality of cushioning particles between the outsole and the upper barrier layer.

2. The sole structure of claim 1, wherein the plurality of pillars are arranged along an arcuate path in the heel region.

3. The sole structure of claim 1, wherein each of the pillars extends from a first end attached to the ramp surface to a terminal end aligned with the bottom surface.

4. The sole structure of claim 1, wherein a cross-sectional area of at least one of the pillars tapers in a direction away from the ramp surface.

5. The sole structure of claim 1, wherein the pillars are spaced inwardly from an outer periphery of the cushioning element.

6. The sole structure of claim 1, wherein at least one of the pillars is arcuate.

7. The sole structure of claim 1, wherein the cushioning element further includes a midfoot pocket and at least one forefoot pocket.

8. The sole structure of claim 7, wherein the midfoot pocket and the forefoot pocket each includes cushioning particles disposed therein.

9. The sole structure of claim 7, wherein the upper barrier layer is attached to the top surface of the cushioning element to enclose each of the heel pocket, the midfoot pocket, and the forefoot pocket.

10. The sole structure of claim 1, wherein the upper barrier layer is formed of a permeable material.

11. A sole structure for an article of footwear, the sole structure comprising:

a cushioning element having a top surface, a bottom surface including a ramp surface disposed in a heel region and offset towards the top surface, the cushioning element including (i) a channel extending through the top surface and the ramp surface to form a bottom opening opposite of a top opening and (ii) a plurality of pillars extending from the ramp surface and surrounding the bottom opening, each of the pillars of the plurality of pillars spaced apart from each other to define a gap;

an outsole attached to the cushioning element and covering the bottom opening and each of the pillars; and a plurality of cushioning particles disposed within the channel and surrounding each of pillars of the plurality of pillars and freely flowing between adjacent pillars of the plurality of pillars.

12. The sole structure of claim 11, wherein the pillars of the plurality of pillars are arranged along an arcuate path in the heel region.

13. The sole structure of claim 11, wherein each of the pillars of the plurality of pillars extends from a first end attached to the ramp surface to a distal end aligned with the bottom surface.

14. The sole structure of claim 11, wherein a cross-sectional area of at least one of the pillars of the plurality of pillars tapers in a direction away from the ramp surface.

15. The sole structure of claim 11, wherein each of the pillars of the plurality of pillars are spaced inwardly from an outer periphery of the cushioning element.

16. The sole structure of claim 11, wherein at least one of the pillars of the plurality of pillars is arcuate.

17. The sole structure of claim 11, wherein the channel includes at least one of a forefoot pocket, a midfoot pocket, and a heel pocket.

18. The sole structure of claim 17, wherein the at least one of the forefoot pocket, the midfoot pocket, and the heel pocket includes cushioning particles disposed therein.

19. The sole structure of claim 17, further comprising an upper barrier layer attached to the top surface of the cushioning element to enclose at least one of the heel pocket, the midfoot pocket, and the forefoot pocket.

20. The sole structure of claim 19, wherein the upper barrier layer is formed of a permeable material.

* * * * *